US006382269B1

(12) United States Patent
Tatsuno

(10) Patent No.: US 6,382,269 B1
(45) Date of Patent: May 7, 2002

(54) AUTOMATIC FUELING SYSTEM

(75) Inventor: Hiyoshi Tatsuno, Tokyo (JP)

(73) Assignee: Tatsuno Corp., Tokyo (JP)

( * ) Notice: Subject to any disclaimer, the term of this patent is extended or adjusted under 35 U.S.C. 154(b) by 0 days.

(21) Appl. No.: 09/668,354

(22) Filed: Sep. 25, 2000

(30) Foreign Application Priority Data

Feb. 22, 2000 (JP) ..... 12-043783
Feb. 22, 2000 (JP) ..... 12-043784
Jun. 5, 2000 (JP) ..... 12-167102

(51) Int. Cl.[7] ..... B65B 1/04

(52) U.S. Cl. ..... 141/94; 141/192; 141/104; 141/392

(58) Field of Search ..... 141/59, 98, 94, 141/231, 312, 368, 382, 388, 192, 392, 198, 104

(56) References Cited

U.S. PATENT DOCUMENTS 3,642,036 A * 2/1972 Ginsburgh et al. ..... 141/94
5,609,190 A * 3/1997 Anderson et al. ..... 141/59
6,003,568 A * 12/1999 Strnad, Jr. ..... 141/98
6,250,347 B1 * 6/2001 Tatsuno ..... 141/198

FOREIGN PATENT DOCUMENTS

JP 5841095 3/1983
JP 63125196 5/1988
JP 6115598 4/1994
JP 8169498 7/1996
JP 9156699 6/1997
JP 11328535 11/1999

* cited by examiner

*Primary Examiner*—Steven O. Douglas
(74) *Attorney, Agent, or Firm*—Birch, Stewart, Kolasch & Birch, LLP

(57) ABSTRACT

An automatic fueling system to be provided in a gas station for dispensing fuel to a vehicle contains a fueling machine containing a fueling pipe led to a fuel-storage tank provided in the gas station, and a fueling nozzle connected to the fueling pipe via a hose, a nozzle conveyance unit containing an arm mechanism, a mechanism control unit for controlling the movement of the arm mechanism, and a fuel-port sensor for sensing the position of a fueling port of the vehicle, the nozzle conveyance unit automatically conveying the fueling nozzle to the fueling port and automatically inserting the fueling nozzle thereto under the control of the mechanism control unit, and a data input/output apparatus for inputting fueling information therefrom and outputting the fueling information to the fueling machine and the nozzle conveyance unit, the fueling nozzle being conveyed by unit of the nozzle conveyance unit to the fueling port in either case where the fueling port faces the fueling machine or the fueling port does not face the fueling machine by the receipt of the fueling information from the data input/output apparatus, the fueling machine starting and stopping fueling based on the fueling information, the fueling nozzle being extracted from the fueling port with the receipt of a signal from the mechanism control unit.

20 Claims, 19 Drawing Sheets

AUTOMATIC FUELING SYSTEM

BACKGROUND OF THE INVENTION

1. Field of the Invention

The present invention relates to an automatic fueling system, more specifically to an automatic fueling system wherein fueling can be performed to a vehicle of which fueling port is existed on either side of the vehicle and by which all the fueling operation steps are automatically carried out without manual operations.

The present invention further relates to an automatic fueling system of which production can be carried out by a minimum manufacturing cost, and by which all the fueling operation steps are carried out without manual operations.

2. Discussion of Related Art

Recently, many proposals were made to prepare fueling systems which are convenient, safe, and advantageous in view of cost.

For instance, fueling systems are reported which have fuel-sort discrimination units for preventing from dispensing different sorts of fuel from the ones in fuel tanks of cars as disclosed in Japanese Kokai Publications 6 (1994)-115598 and 8 (1996)-169498, fueling systems which automatically dispense fuel to cars to the full-tank level thereof by the provision of full-tank fueling units as disclosed in Japanese Kokai Publications 58 (1983)-41095 and 63 (1988)-125196.

All of the above-mentioned fueling systems are effectively used with a minimum number of fueling operators. These systems, however, need well-trained fueling operators, for inserting fueling nozzles to fueling ports of cars.

As Japanese Kokai Publication (1997)-156699 and Japanese Patent Application 11(1999)-328535, an automatic fueling system is disclosed wherein all the fueling steps are automatically carried out substantially without a manual operation. However, it is impossible to perform fueling to a car of which fueling port locates opposite to the fueling mechanism. Namely, drivers of the car have to always recognize on which sides of the cars the fueling ports exist, and they need to chose fueling machines which are to face the fueling port of their cars.

SUMMARY OF THE INVENTION

It is therefore an object of the present invention to provide an automatic fueling system by which can be perform fueling to a vehicle entered a fueling area regardless of the direction of the fueling port of the vehicle with respect to the fueling machine, and by which all the fueling steps are carried out automatically.

A second object of the present invention is to provide an automatic fueling system which can be manufactured by a minimum cost, and by which all the fueling steps are carried out automatically.

The first object of the present invention is attained by an automatic fueling system to be provided in a gas station for dispensing fuel to a vehicle, comprising a fueling machine comprising a fueling pipe led to a fuel-storage tank provided in the gas station, and a fueling nozzle connected to the fueling pipe via a hose; a nozzle conveyance means comprising an arm mechanism, a mechanism control unit for controlling the movement of the arm mechanism, and a fuel-port sensor for sensing the position of a fueling port of the vehicle the nozzle conveyance means automatically conveying the fueling nozzle to the fueling port and automatically inserting the fueling nozzle thereto under the control of the mechanism control unit; and a data input/output apparatus for inputting fueling information therefrom and outputting the fueling information to the fueling machine and the nozzle conveyance means, the fueling nozzle being conveyed by means of the nozzle conveyance means to the fueling port in either case where the fueling port faces the fueling machine or the fueling port does not face the fueling machine by the receipt of the fueling information from the data input/output apparatus, the fueling machine starting and stopping fueling based on the fueling information, the fueling nozzle being extracted from the fueling port with the receipt of a signal from the mechanism control unit.

The second object of the present invention is attained by an automatic fueling system to be provided in a gas station for dispensing fuel to a vehicle, comprising a fueling machine comprising at least one fueling pipe led to a fuel-storage tank provided in the gas station, and a fueling nozzle connected to the fueling pipe via a hose; a nozzle conveyance means comprising an arm system, a mechanism control unit, for automatically conveying the fueling nozzle to a fueling port of the vehicle by grasping the fueling nozzle, and automatically inserting the fueling nozzle by the movement of the arm system under the control of the mechanism control unit; and a data input/output apparatus for inputting fueling information therefrom and outputting the fueling information to the fueling machine and the nozzle conveyance means, the fueling machine starting and stopping fueling based on the fueling information, the fueling nozzle being extracted from the fueling port with the receipt of a signal from the mechanism control unit, the nozzle conveyance means being independent of the fueling machine.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
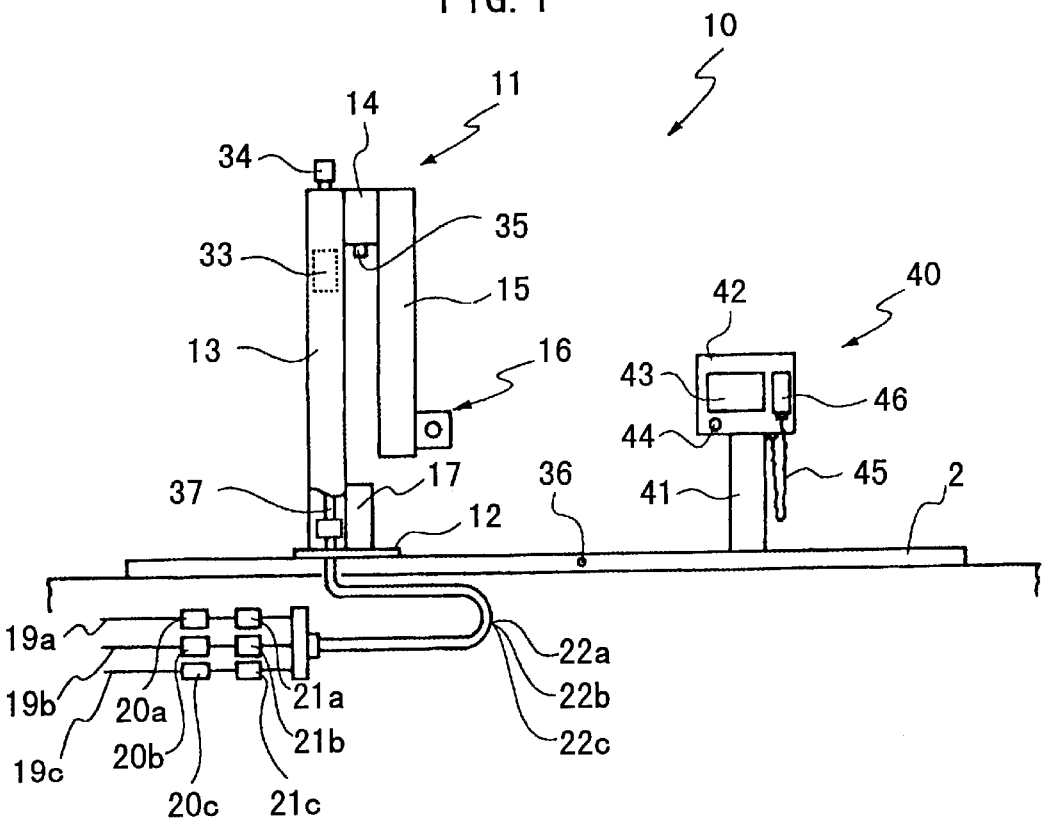
FIG. 1 is a front view of an automatic fueling system according to the present invention.

In accordance with a first aspect of the present invention, there is provided an automatic fueling system comprising a fueling machine, a nozzle conveyance means and a data input/output apparatus for inputting fueling information therefrom and outputting the fueling information to the fueling machine and the nozzle conveyance means. The nozzle conveyance means for use in the present invention is novel, comprising an arm mechanism, a mechanism control unit for controlling the movement of the arm mechanism, and a fuel-port sensor for sensing the position of the fueling port. The nozzle conveyance means automatically conveying the fueling nozzle to a fueling port of a car and automatically inserting a fueling nozzle of the fueling machine thereto. It is preferable that the fuel-port sensor sense the position of the fueling port by detecting a signal generated from a transmitter provided on the vehicle nearby the fueling port.

By the fueling system according to the present invention, the fueling nozzle is conveyed by means of the nozzle conveyance means, to the fueling port in either case where the fueling port faces the fueling machine or the fueling port does not face the fueling machine by the receipt of the fueling information from the data input/output apparatus. The fueling machine starts and stops fueling based on the fueling information, and the fueling nozzle is extracted from the fueling port after the automatic fueling operation is completed under the control of the mechanism control unit.

It is possible in the present invention to provide a fueling system wherein the fueling machine and the nozzle conveyance means are united. For instance, the fueling machine can play a role of a support for the nozzle conveyance means. Namely, the fueling pipe of the fueling machine can be introduced in the arm mechanism, passed therethrough in the longitudinal direction, and can project therefrom.

In accordance with a second aspect of the present invention, there is provided an automatic fueling system comprising a fueling machine, a nozzle conveyance means and a data input/output apparatus for inputting fueling information therefrom and outputting the fueling information to the fueling machine and the nozzle conveyance means, of which nozzle conveyance means is provided independently of the fueling machine. The nozzle conveyance means comprises an arm system, a mechanism control unit, for automatically conveying the fueling nozzle to a fueling port of a car to be fueled. The fueling nozzle of the fueling system is grasped by the arm system and automatically inserted to a fueling port of a car. The movement of the arm system is controlled by the mechanism control unit. The fueling machine starts and stops the automatic fueling operation based on the fueling information from the data input/output apparatus. With the completion of fueling, the fueling nozzle is extracted from the fueling port with the receipt of a signal from the mechanism control unit.

In the fueling system of the second aspect, it is preferable that a camera such as CCD camera and an image processing means are provided on the nozzle conveyance means, and that a fueling port of a car to be fueled is detected.

Other features of this invention will become apparent in the course of the following description of exemplary embodiments, which are given for illustration of the invention and are not intended to be limiting thereof.

Figure 2:
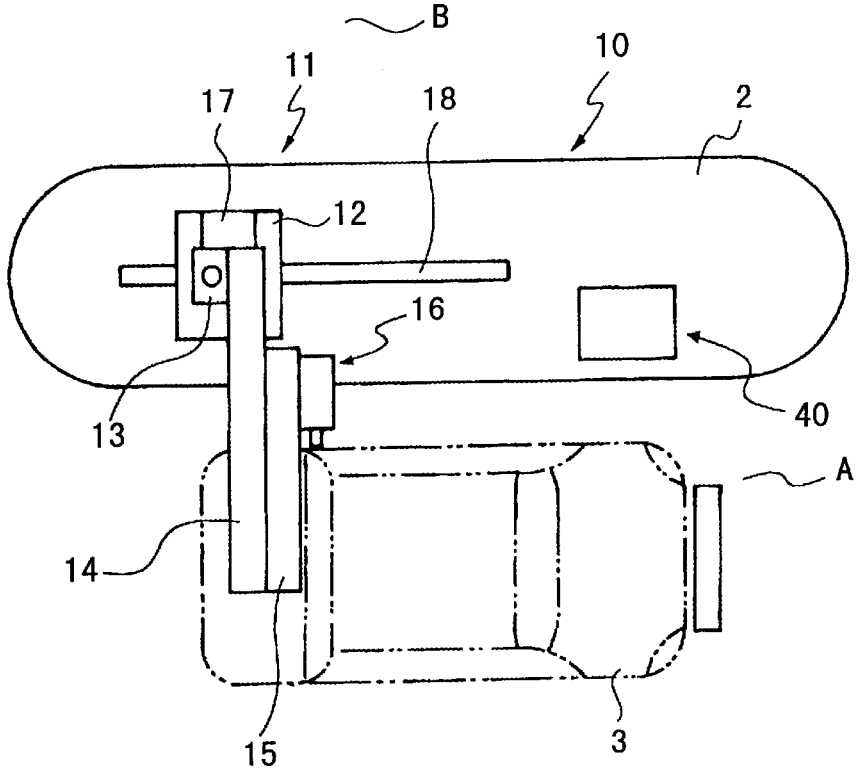
FIG. 2 is a plan view of the automatic fueling system according to the present invention.

A first preferred embodiment of the automatic fueling system 10, as a first aspect, according to the present invention is illustrated as a front view in FIG. 1, and a plan view of the fueling system 10 is described in FIG. 2. In each of FIGS. 1 and 2, a fueling machine 11 and a data input/output apparatus 40 are provided on an island 2 in a fueling area A (FIG. 2). In the present invention, a fueling nozzle (not shown) in the fueling machine is automatically moved to a position corresponding to a fueling port of a car 3 stopped at the fueling area A.

The fueling machine 11 in this first embodiment contains of a long and narrow support 13 stood upon a base plate 12 on the island 2. A first arm member 14 is linked to the support 13 by the rotational connection of the upper end of the support 13 with one end of the first arm member 14, and a second arm member 15 is rotatably linked to the other end of the first arm member 14. Here, the support, and the first and the second arm members constitute an arm mechanism. Another end of the second arm member 15 is further linked with a nozzle mechanism 16 with the rotational linkage therebetween. The fueling machine 11 in the first embodiment is moved back and forth along a rail 18 provided on the island 2 by the control of a horizontal movement control unit 17 provided on a base plate 12 by the support 13.

On the island 2, as shown in FIG. 1, an entry sensor 36 is provided for sensing the entrance of a car to the fueling area. Below the island (underground), fueling pipes 19*a*, 19*b* and 19*c* are connected to fuel-storage tanks provided underground (not shown) respectively of regular, premium and diesel. The fueling pipes 19*a*, 19*b* and 19*c* are connected to hoses 22*a*, 22*b* and 22*c* which are introduced to the support 13 with the provision therebetween pumps 20*a*, 20*b* and 20*c* and flow-meters 21*a*, 21*b* and 21*c*. As will precisely explained later in relation to FIG. 4, the hoses 22*a*, 22*b* and 22*c* are respectively connected to fueling nozzles in a set of pipes 37 passing through the support 13, the first arm member 14 and the second arm member 15, and being lead to the nozzle mechanism 16. Each of the pipes 37 is linked by joint members such as rotational joints and/or hoses to perform smooth movements of the linked parts in the support 13, the first arm member 14, the second arm member 15, and the nozzle mechanism 16, and not to hinder the necessary movements, for instance, the expansion and contraction of the arms members.

Figure 4:
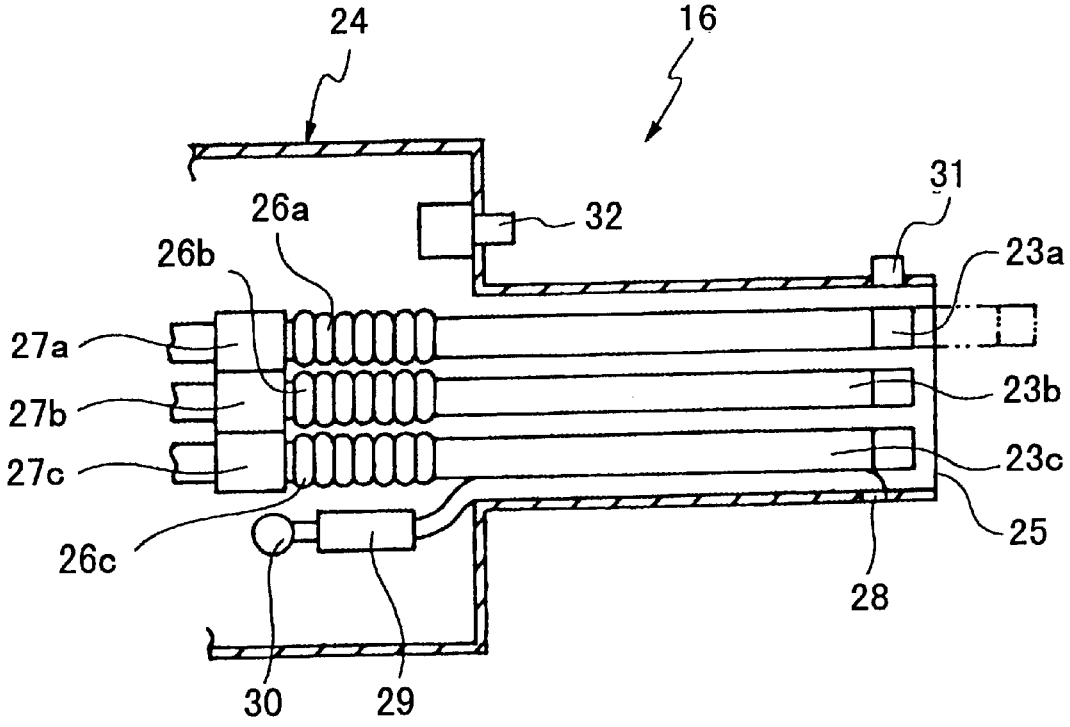
FIG. 4 is a cross-section of a nozzle mechanism for use in the present invention.

In each of FIGS. 1 and 4, an entrance judge lamp 34 is provided on the support 13 which indicates whether or not a car can enter the fueling area A. For instance, when it is ready to accept a car to the fueling area, a blue lamp is lit, while when it is not ready to accept a car thereto, a red lamp is lit. Moreover, a fueling position sensor 35 for detecting on which side of a car a fueling port exists is provided on the second arm member 14 around a rotationally linked part with the second arm member 15.

The nozzle conveyance means in this embodiment is composed of the first arm member 14; the second arm member 15; the nozzle mechanism 16; a rotary movement control unit 33; the horizontal movement control unit 17 by which the movements of the first arm member 14, the second arm member 15 and the nozzle mechanism 16 are controlled; the fueling position sensor 35; and the fueling port sensor 32. The nozzle conveyance means carries a fueling nozzle to an appropriate position to be fit to a fueling port of a car even when the fueling port exists on the opposite side with respect to the fueling machine.

Figure 3:
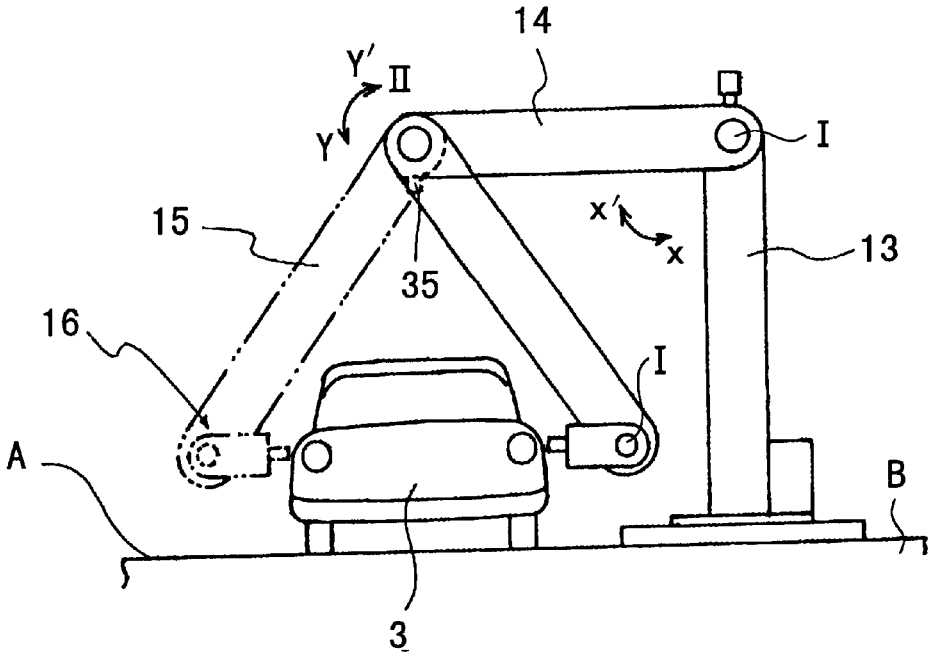
FIG. 3 is a schematic view of a fueling system of the present invention for explaining components and a fueling state thereof.

By the provision of the nozzle conveyance means, a car with a fueling port on either side thereof can be smoothly fueled as illustrated in FIG. 3.

In FIG. 3, the support 13 is formed to have the top end thereof much higher than a roof of a car 3 to be fueled in the fueling area A with taking into consideration the fueling to a car of which fueling port is on the opposite side with respect to a fueling machine (hereinafter referred to as opposite-side fueling). The first arm member 14 rotates on the axis I with respect to the support 13 in the directions shown by arrows X, X' to be horizontally provided above the roof of the car. The second arm member 15 rotates in the directions of arrows Y, Y' on the axis II with respect to the first arm A. Here, the length of the first arm member 14 is determined as the end connected with the second arm member 15 locates above the car roughly at the center part thereof, and the length of the second arm member 15 is decided to be enough to reach a fueling port either on a nearby side (shown by a solid line) or opposite side (shown by a two-dot chain line) with respect to the fueling machine. As shown in FIG. 3 the nozzle mechanism 16 is rotary connected to the second arm member 15 and the fueling is performed with the insertion of one of nozzles to the fueling port of the car, of which mechanism is explained below.

FIG. 4 is a cross-section of the nozzle mechanism 16. One end of a casing 24 is connected to the second arm member (FIG. 3), and the other end thereof opened forming an opening 25 with being protruded, thereby forming a discharge pipe. The fueling nozzles 23*a*, 23*b* and 23*c* is contained in the casing 24, one of the fueling nozzles 23*a*, 23*b* and 23*c* is to be extruded from the opening 25 as indicated by a two-dot chain line for the case of the fueling nozzle 23*a*. The extrusion of the fueling nozzles 23*a*, 23*b* and 23*c* are performed by the provision of bellows 26*a*, 26*b* and 26*c* and opening-closing valves 27*a*, 27*b* and 27*c*, and the fueling nozzles 23*a*, 23*b* and 23*c* are connected to the hoses 22*a*, 22*b* and 22*c* contained in the previously mentioned pipes 37 via the valves 27*a*, 27*b* and 27*c*. The casing 24 has an insertion sensor 31 and a vapor absorption port 28 at the side of the opening 25, and the vapor absorption port 28 is connected to a sensor 29, and then to an absorption pump 30. Furthermore, a fuel-port sensor 32 for detecting a fuel port of a car is provided on the casing 24.

Referring back to FIG. 1, the data input/output apparatus 40 is composed of a stand 41 and a housing part 42 wherein provided are an indicator 43, a communicator 44, and a data input mobile 46 connected to the casing by means of a signal line 45.

Figure 5:
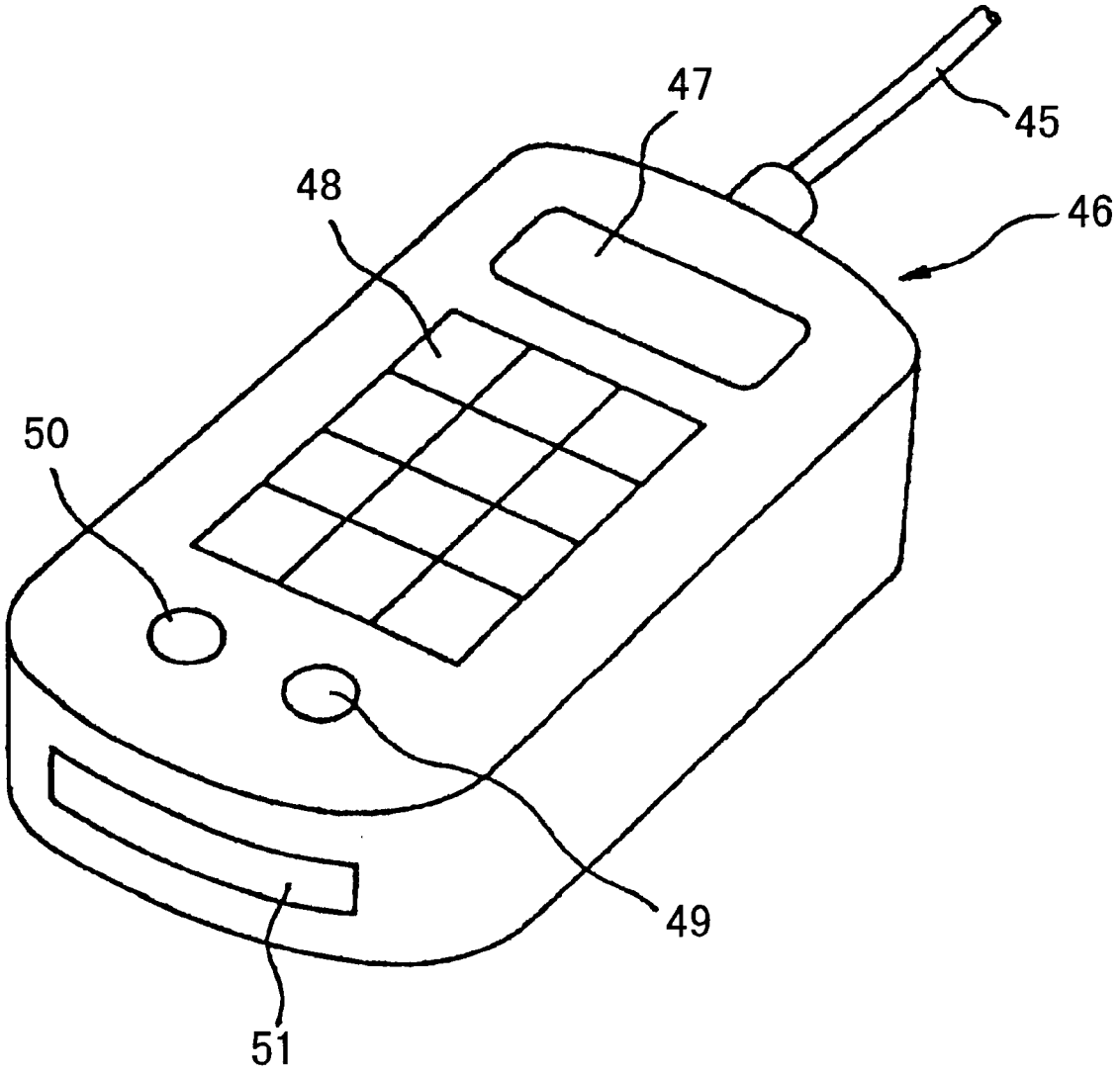
FIG. 5 is a perspective view of a data input mobile for use in the present invention.

As more concretely shown in the perspective view of FIG. 5, the data input mobile 46 has an indication part 47, a keyboard 48, a setting button 49, and a confirmation button 50, and a card reading/writing unit 51. This data input mobile 46 is illustrated as being connected with the signal line 45 to the housing part 42, although the mobile 46 may be prepared as wireless. The card reading/writing unit 51 reads information recorded on a credit card, a banking card, a fueling card, a prepaid card, and an IC card, and writes new information thereon.

The functional relationship of the constituents of the automatic fueling system 10 according to the present invention will be explained more precisely with referring to a block diagram shown in FIG. 6.

The fueling machine 11 comprises a fuel-control unit 60 comprising, for instance, a full-tank fueling unit 61 and a fuel-sort discrimination unit 62, the fuel-control unit 60 being connected to a pump 20, a flow-meter 21, an opening-closing valve 27, a fuel-sort sensor 29, a suction pump 30, and an insertion sensor 31.

Furthermore, the fueling machine 11 is provided with a rotary movement control unit 33 for controlling the movements of the first arm member 14, the second arm member 15 and the nozzle mechanism 16 independently of the movement of each other. A horizontal movement control unit 17 causes the fueling machine 11 to horizontally move along the rail 18 previously mentioned in relation to FIG. 2. The rotary movement control unit 33 and the horizontal movement control unit 17 are connected with a mechanism control unit 63 which is further connected with a fueling position sensor 35 for detecting on which side of a car a fueling port exists, and a fuel-port sensor 32 for exactly detecting the position of a fuel port of a car.

The data input/output apparatus 40, on the other hand, contains a data control unit 64 for controlling data input and output. The control unit 64 is connected with an entry sensor 36, an entrance judge lamp 34, a keyboard 48, an indicator 43, a card reading/writing unit 51, a communicator 44, a setting button 49, a confirmation button 50, and an indication part 47. Data transmission is performed from the data input/output apparatus 40 to the fueling apparatus 11, and vice versa.

Figure 7:
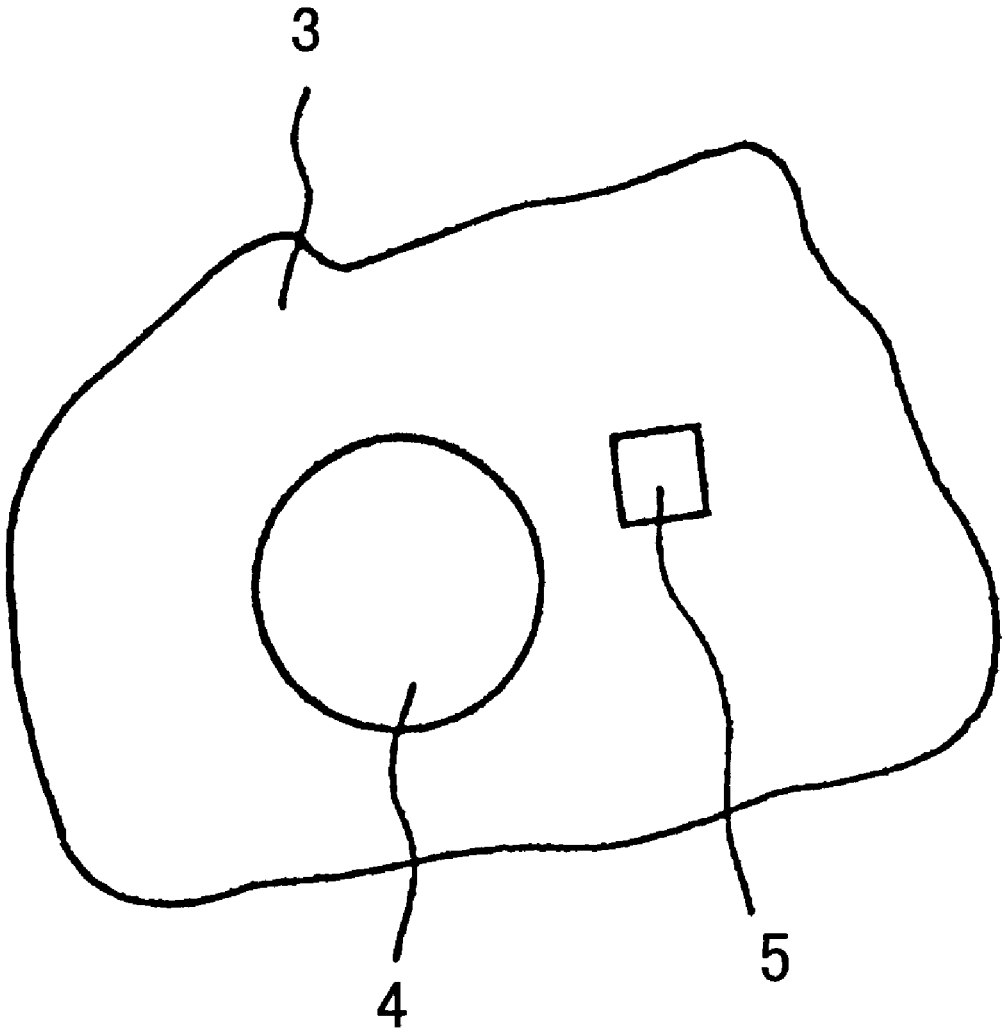
FIG. 7 is a schematic diagram of a fueling port of a car to be fueled by the automatic fueling system of the present invention.

A car 3 to be fueled by the automatic fueling system according to the present invention should have a transmitter 5 such as a transponder nearby a fuel port 4 of the car for transmitting a positional information of the fuel port as shown a partial diagram of FIG. 7.

The control functions of the fueling machine 10 and the data input/output apparatus 11 for use in the present invention will be explained respectively based on flow-charts in FIGS. 8 and 9.

Figure 10:
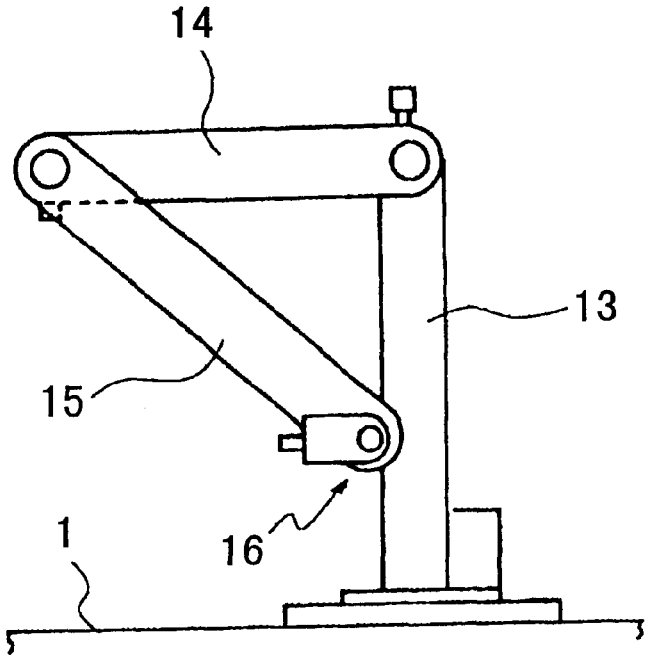
FIG. 10 is a diagram for explaining a waiting position of a fueling machine for use in the present invention.

In the case where there is no car in a fueling area, the entrance judge lamp 34 is being lit in blue, which is considered in the first embodiment as the indication of the allowance for a car to newly get into the fueling area. At this stage, as fueling machine 11 is in an initial state, namely in a waiting position, as shown in FIG. 10, with the first arm member 14 at the top of the support 13 being maintained in a horizontal position, the second arm member 15, in a inclined position by the tip with the nozzle conveyance means directed to the support 13, and the free end of the nozzle mechanism 16 pointing the end with the above-mentioned opening 25 to the fueling area A.

When a car enters the fueling area A and the entry sensor 36 turns on with the detection of the entrance of the car thereto (ST 1 in FIG. 1), the data control unit 64 receives a car-detection signal to change the entry judge lamp from blue to red (ST 2) to notify other cars the impossibility to enter the fueling area A.

The input of fueling data to the data input/output apparatus 40 is carried out by a customer with inserting a card such as a credit card, a banking card, a fueling card, a pre-paid card, or an IC card to the card reading/writing unit 51 of the data input mobile 46 (ST 3), whereby the automatic fueling system of the present invention becomes ready for the following steps of the automatic fueling operation. When fueling data such as a required fuel sort and a quantity thereof is input from the keyboard (ST 4), the input data is indicated on the indicator 43 and the indication part 47. The confirmation button 50 is pressed (ST 5) when the indicated data is confirmed to be correct, and then the setting button 49 is pressed for the fixation of the fueling data (ST 6). Thus, the data control unit 64 transmits the fixed data to the fueling machine 11.

Figure 9:
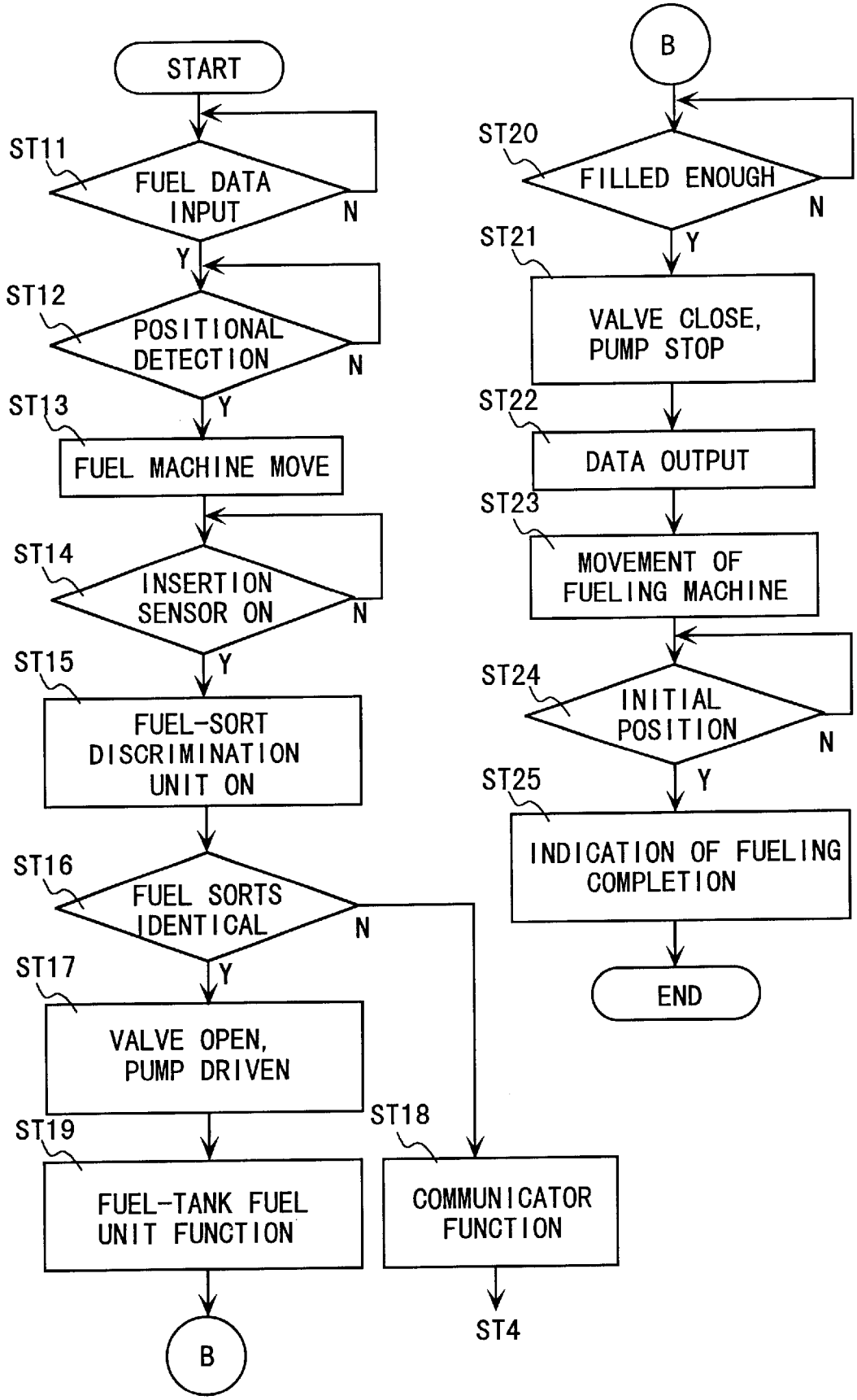
FIG. 9 is a flow-chart for explaining the function of a fueling machine for use in the present invention.

Thus, the fuel data is transmitted from the data control unit 64 of the data input/output apparatus 40 to the mechanism control unit 63 in the fueling machine 11 (ST 11 in FIG. 9). Thereafter, the positional detection of the fuel port is carried out by means of the fueling position sensor 35 on the first arm member 14, and the fuelport sensor 32 on the nozzle mechanism 16 (ST12), the mechanism control unit 63 causes the horizontal movement control unit 17 and the rotary movement control unit 33 to move the tip of the nozzle mechanism 16 to a position facing the fuel port of the car (ST 13). Here, the fueling position sensor 35 detects on which side the fueling port exists (rough detection), and the fuel-port sensor finely detects the position of the nozzle mechanism to be set (precise detection).

Where the fueling port 4 is detected by the fueling position sensor 35 to locate on a side facing the fueling machine 11 (nearby side), the fuel-port sensor 32 receives a positional signal generated from the transmitter 5 in the waiting position as shown in FIG. 10. Based upon the detection signal, the mechanism control unit 63 gives a signal to the horizontal movement control unit 17 to control the fueling machine 11 to move along the rail 18, in parallel giving a signal to control the rotary movement control unit 33 to rotary move the second arm member 15 and the nozzle mechanism 16, and fit the tip of the casing 24 of the nozzle mechanism 16 to a position facing the fueling port.

When the fueling port 4 is detected to exist on the opposite side of the car body with respect to the fueling machine 11 by the fueling position sensor 35 (opposite side), the mechanism control unit 63 controls the rotary movement control unit 33 to rotate the first and second arm members 14 and 15 and nozzle mechanism 16, so as to carry the nozzle mechanism 16 beyond the roof of the car, for instance, by bringing the first and second arm members 14 and 15 to be overlaid, then raising the connected part around the axis II upwards, e.g. to rotate the first and second arm members 14 and 15 on the axis I in the overlaid state to place a wide angle with respect to the support 13, followed by bringing the second arm member 15 to the position for the opposite-side fueling as previously shown with the two-dot chain line in FIG. 3.

After the rough detection, either in opposite-side fueling or nearby-side fueling, the fuel-port sensor 32 receives a positional signal transmitted from the transmitter 5, as described above, with the nozzle conveyance means set in this state. Thereafter, the tip of the nozzle mechanism is brought to a position nearby the fueling port of the car.

With the tip of the nozzle having been moved to a position facing the fueling port, the second arm member 15 is caused to rotate to insert the nozzle mechanism to the fueling port, so that the insertion sensor 31 is turned on (ST 14). At this stage, the fuel-control unit 60 causes the suction pump 30 to absorb vapor in a fuel tank of the car, and the fuel-sort discrimination unit 62 causes to work the fuel-sort sensor 29 for sensing the sort of fuel in the vapor form (ST 15). The fuel-sort discrimination unit 62 judges if the fuel sort sensed by the fuel-sort sensor 29 is identical with the fuel-sort which has been instructed by the data input from the keyboard of the data input/output apparatus 40 (ST 16). The fuel-control unit 60 opens the opening/closing valve 27 of a required fuel sort and starts to drive the corresponding pump 20 when the fuel sorts are identical with each other (ST 17).

The fuel stored in an underground fuel-storage tank is transferred through a corresponding fueling pipe 19 under the pressure application by means of the pump 20, and discharged into a fueling port by way of the flow-meter 21, the hose 22, the pipes 37, the opening/closing valve 27, the bellow 26, and the fueling nozzle 23. The tip of the fueling nozzle 23 contained in the nozzle mechanism 16 projects from the opening 25 of the nozzle mechanism 16, with the bellow 26 extended by the liquid pressure of fuel driven by the pump 20. Accordingly, a selected fueling nozzle 23 is deeply inserted to the fueling tank of a car, so that the fuel is never scattered outside the fueling port 4. The fueling quantity measured by the flow-meter 21 is indicated on the indicator 43 and the indication part 47.

As the fueling is being performed in this way, a full-tank fueling unit 61 functions (ST 19). When the full-tank fueling unit 61 detects that the car is filled with fuel of a preset quantity or filled to a full-tank level (ST 20), the fuel control unit 60 closes the opening-closing valve 27, stops the pump 20 (ST 21), and outputs the data of the fueled quantity to the data input/output apparatus 40 (ST 22). Subsequently, the mechanism control unit 63 controls the rotary movement control unit 33 and the horizontal movement control unit 17 to extract the nozzle mechanism from the fueling port 4, with the main body of the fueling machine 11 and the first and the second arm members 13 and 14 moved (ST 23) back to the initial waiting position (ST 24). Thereafter, the communicator 44 indicates the completion of fueling (ST 25).

On the other hand, the data input/output apparatus 40, into which fueling data has been input, outputs the data to the fueling machine 11 (ST 7) as mentioned previously. The data input/output apparatus waits for data to be input from the fueling machine 11 while the fueling is performed by the fueling machine 11. After the data of actually fueled quantity is input from the fueling machine 11 to the data input/output apparatus 40 (ST 8), the apparatus 40 comes to be ready for accepting a customer's card for clearing off the fueling charge. With the completion of clearing off (ST 9), the color of the entrance judge lamp is changed from red to blue. Thus, all the fueling steps are completed.

If it is judged at ST 16 in FIG. 9 that the fuel sort already existing in the tank of the customer's car is not identical with the selected fuel sort to be dispensed, the data control unit 64 causes the communicator 44 to function for a certain period of time (ST 18) to indicate the necessity to come back to ST 4 in FIG. 8, that is, to input again a new data. With the input of a correct fuel sort from the keyboard 48, the subsequent fueling steps are carried out as described above.

It is preferable that the fueling machine 11 have the waiting state as shown in FIG. 10 for smoothly starting fueling any time. The first and second arm members 14 and 15 and the nozzle mechanism 16 can be rotated as to be brought to assume a waiting state for a fueling area B (FIG. 2) opposite with respect to the island. Moreover, it is possible that the waiting position is decided as the position for the opposite-side fueling, as regards to the fueling in both the fueling areas A and B. With the position for the opposite-side fueling as shown by the two-dot chain line in FIG. 4 employed as a waiting position, cars can be fueled by passing through the arm members 14 and 15, and thereafter the fueling operation is carried out.

Figure 11:
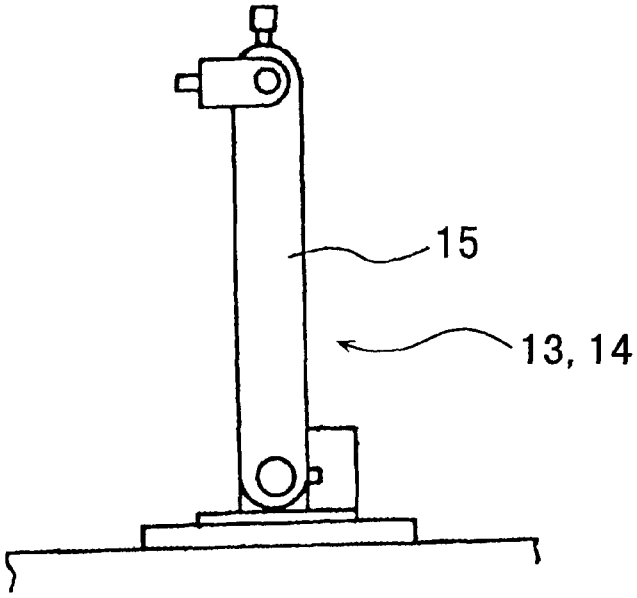
FIG. 11 is a diagram for explaining an end position of a fueling machine for use in the present invention.

Furthermore, the first and second arm members 14 and 15 can be laid on the support 13 as shown in FIG. 11. This end position, which does not interrupt the entrance or the leaving of a car, is preferably employed as an end position when the fueling operation has been completed.

In the above-embodiment, the nozzle conveyance means was explained as being composed of the first and second arm members, nozzle mechanism, mechanism control unit, horizontal movement control unit, rotary movement control unit, fueling position sensor, and fueling port sensor, and the nozzle mechanism is moved in a position appropriate for fueling by the rotational movements of the first and second arms and the nozzle mechanism by means of the mechanism control unit.

The arm mechanism may comprise three or more of arm members, and the lengths of the arms or the shapes thereof being selected to be appropriate with the opposite-side and nearby-side fueling taken into consideration. Moreover, it is possible to cause the support to rotate by that the provision of the horizontal movement control unit can be omitted.

A second preferred embodiment of the automatic fueling system, as a first aspect, of the present invention will now be explained, wherein a nozzle conveyance means is prepared in a different fashion from that in the above-mentioned first embodiment.

The automatic fueling system 10 of the present invention can be prepared as shown in a view shown in FIG. 12, wherein a fueling machine 11 with a nozzle conveyance means (which will be explained later) is provided on an island facing an fueling area A. A data input-output apparatus 40 is provided next to the fueling machine 11 as shown in FIG. 13.

Figure 12:
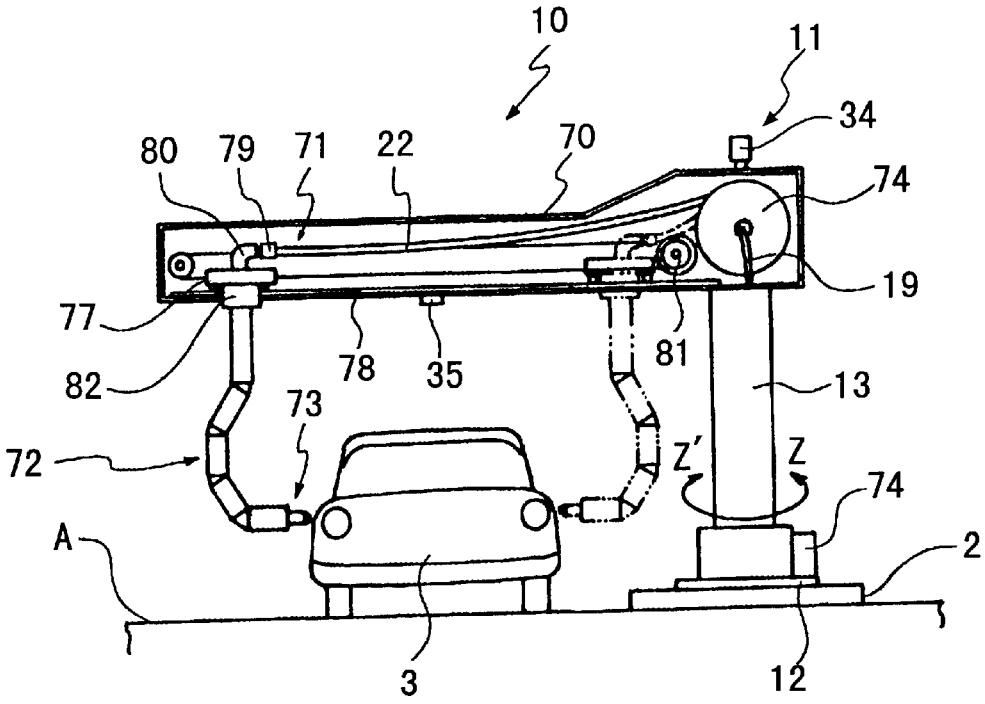
FIG. 12 is a schematic view of a fueling system of the present invention for explaining components and a fueling state thereof.
Figure 13:
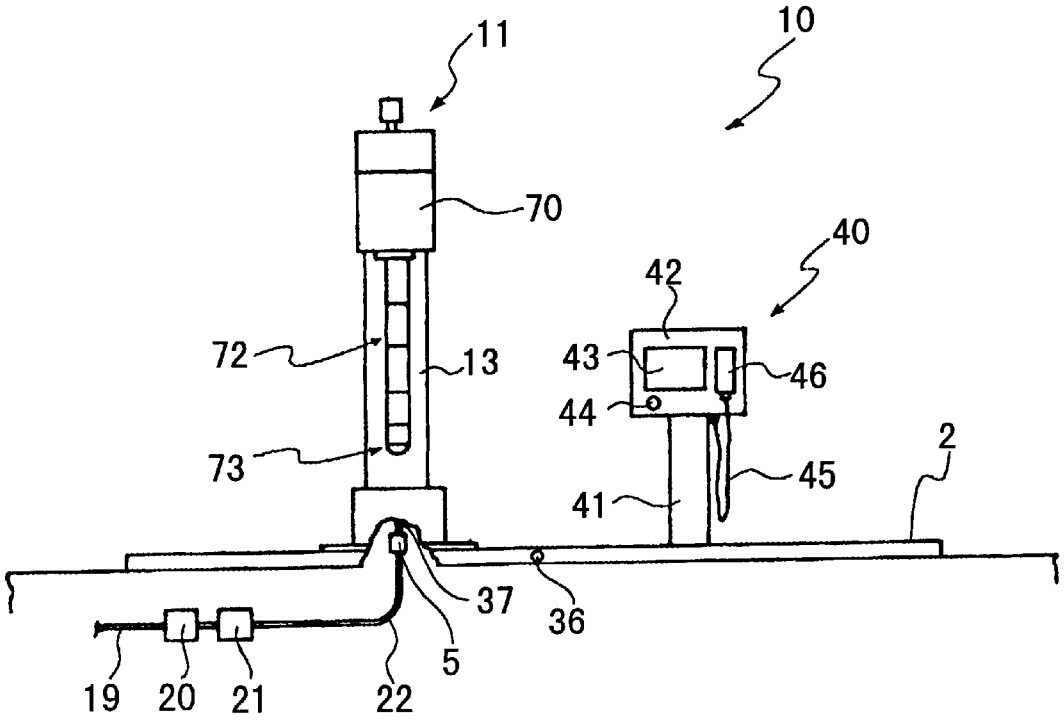
FIG. 13 is a front view of an automatic fueling system according to the present invention.

Referring to FIG. 12, the fueling machine 11 in the second embodiment has a long and narrow support 13 stood upon a base plate 12 on an island 2. A hose container 70 is linked to the support 13 by the rotational connection of the upper end of the support 13 with one end of the hose container 70. The other end of the container 70 is protruded above the fueling area A.

A hose carrier unit 71 is the system with the hose container, and an articulated arm system 72 is fit to the hose carrier unit 71, with the provision of a nozzle mechanism 73 at the free end of the articulated arm system 72. For performing fueling to a car 3, the support 13 is rotary moved in the directions as described by arrows Z and Z' by means of a support rotation means 74 which is, for instance, provided nearby the support 13.

Also in the second embodiment, the support 13 is formed to have the top end thereof much higher than a roofs of a car 3 to be fueled in the fueling area A with taking into consideration the opposite-side fueling. The hose container 70 can be formed, as shown in this embodiment, as a long and narrow box-like shape having the part attached to the support 13 to be wider than the other end, and the length thereof can be decided as the free end extends as to be enough for the opposite-side fueling. In FIG. 12, the hose container 70 is illustrated to have a length exceeding the side of the car opposite to the fueling machine.

An entrance judge lamp 34 and a fueling position sensor 35 which have the same functions as those explained in relation to the first embodiment are employed also in the second embodiment. In this embodiment, the entrance judge lamp 34 is provided on the upper surface of the hose container 70 at the end above the support 13, and the fueling position sensor 35 is provided on lower surface of the hose container 70 at the longitudinal center thereof.

The above-mentioned hose carrier unit 71 contains in the hose container 70 as shown in FIG. 12, wherein a hose reel 75; a hose 22 which is wound onto the hose reel 75 and drawn out therefrom; and a flat-car 77 for carrying the hose 22; and a rail 78 provided on the bottom of the hose container 70 for guiding the hose 22; a valve 79 which connects the tip of the hose 22 and a hose joint 80 provided on the flat-car 77; and a pulley system 81 by which the flat-car 77 is moved along the rail 78.

FIG. 13 is a front view of the fueling system 10 of the present invention as the second embodiment. Below the island, a fueling pipe 19 is connected to a fuel-storage tank provided underground (not shown). The fueling pipe 19 is introduced to a support 13 by way of a pump 20 and a flow-meter 21 and the rotational joint 5 and is connected to the hose 22 on the hose reel 75 (FIG. 12) in the hose container 70. In FIG. 13, the articulated arm 12 with the nozzle mechanism 73 is suspended from the hose container 73. It is possible in this embodiment to employ a plurality of fueling pipes 19, pumps 20 and flow-meters 21 for the selection of fuel sorts, which are connected to a pipe lead to the support 13 by the connection by means of the rotational joint 5, and that the selected sort of fuel is dispensed passing through the hose container 70 in the same way as described above.

Figure 14:
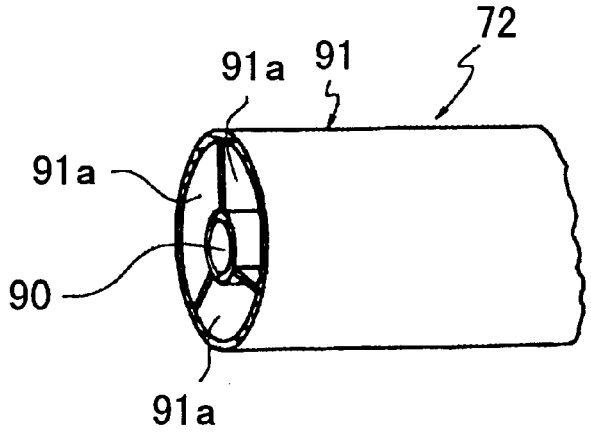
FIG. 14 is a partial view of a bending hose of an articulated arm system for use in the present invention.

The articulated arm system 72 is composed of a bending hose 91 within which an arm hose 90 is contained as shown in a partial view in FIG. 14 and is attached to the bottom surface of the flat-car 77 via a connection 82 as shown in FIG. 12. The arm hose 90 communicates with the above-mentioned hose 22 to passing fuel therethrough to the nozzle mechanism.

The bending hose 91 is a pipe with a diameter appropriate for containing therein the arm hose 90 and can be made of a material such as a fiber reinforced rubber. The space between the inner surface of the bending hose 91 and the outer surface of the arm hose 90 is partitioned in the radial direction to have, for example, 3 air rooms 91*a* and the air rooms 91*a* are also partitioned in the longitudinal direction to give many small air rooms (not shown). The small air rooms are to be filled with compressed air. The bending hose 91 swells equally in the radial direction when compressed air is fed in the same pressure to all the air rooms 91*a*, and the bending hose 91 is bent when the compressed air in different pressures are fed depending on the air rooms, thereby freely changing the shape of the bending hose 91. Accordingly, the small air rooms have a function as a pneumatic actuator to bend the arm hose 90 contained therein to a desired direction, whereby the nozzle mechanism 73 can be conveyed to a desired position which is provided at the end of the bending hose 91.

Compressed air employed for the above-mentioned function can be fed from either of compressors provided in the gas station, which are employed for lifting up a car, washing a car, etc.

Figure 15:
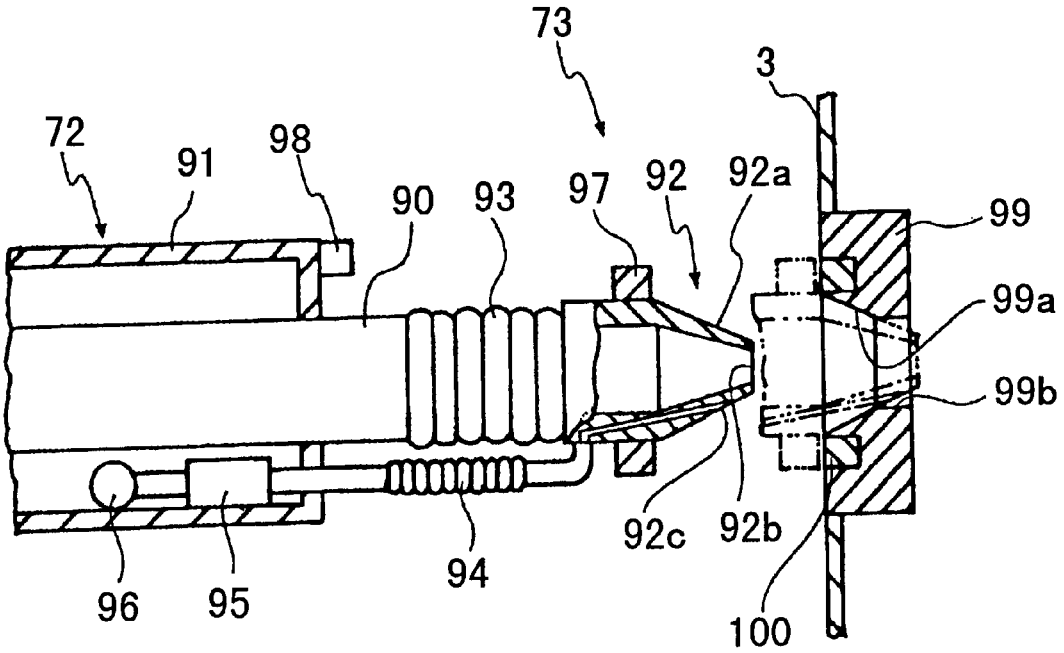
FIG. 15 is a cross-section of another nozzle mechanism for use in the present invention.

FIG. 15 is a schematic cross-section of the nozzle mechanism 73 as a preferable embodiment thereof. Here, the bending hose 91 of the articulated arm system 72 contains the arm hose 90 therein as being protruded therefrom. The nozzle mechanism 73 in this embodiment is composed of a nozzle adaptor 92 which is connected to the arm hose 90 by the provision of a bellow 93 which is extended by the liquid pressure of fuel when fueling is performed. It is possible to use the nozzle adaptor 92 for a car 3 provided with a fuel port adaptor 99 for a fuel port of the car, thereby performing fueling appropriately by fitting the fuel port adaptor 99 with the nozzle adaptor 92.

More precisely, the nozzle adaptor 92 of this embodiment has a short tube shape with a taper 92*a* of which wider end has a diameter to be connected with the bellow 93. A fuel is dispensed from the tip 92*b* of the nozzle adaptor 92. A vapor absorption port 92*c* is provided on the taper 92*a* and is lead to a suction pump 96 via a bellow part 94 and a fuel-sort sensor 95. An excitation coil 97 is provided on the cylindrical part of the nozzle adaptor 92. The fuel port adaptor 99 is to be provided on a fuel port of a car with a concave correspondingly to the shape of the nozzle adaptor 92 having a taper 99*a* and an opening 99*b*. There is provided a magnet 100 in the nozzle adaptor 92 at a position facing to the excitation coil 97. A fuel-port sensor 98 is provided at the edge of the bending hose 91, which is for detecting the position of a fuel port of a car and detecting whether or not the nozzle adaptor 92 is connected with the fuel port adaptor 99.

As mentioned previously, the fueling system 10 according to the present invention in the second embodiment also has a data input/output apparatus 40 provided on the island 2 as shown in FIG. 13. The data input/output apparatus 40 is identical with that shown in FIG. 1, so that same reference numerals are employed for the same members as in FIG. 1. An entry sensor 36 is provided for sensing the entrance of a car to the fueling area.

Figure 16:
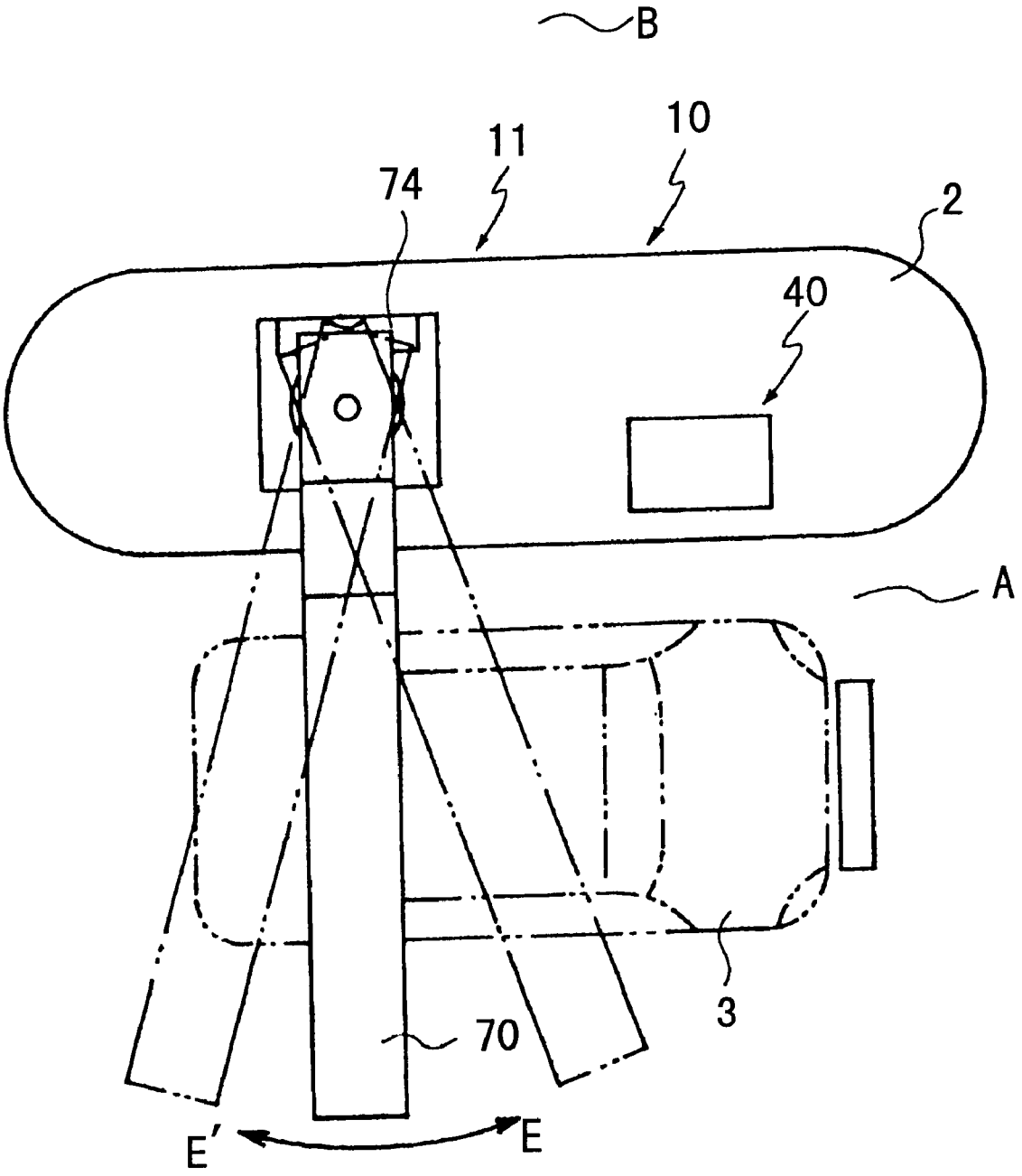
FIG. 16 is a plan view of a fueling system of the present invention.

FIG. 16 is a top diagram of the fueling system 10 of the present invention for explaining the motion of the hose container 70 wherein the fueling machine 11 and the data input/output apparatus 40 are provided on the island 2. In this figure a car 3 is in a fueling area A and the hose container 70 is horizontally protruded over the car 3. The hose container 70 is rotated to the directions of arrows E and E' with the rotation of the support by means of the support rotation means 74, to bring the hose container 70, which is fixed to the support, to an appropriate position facing to the fueling port of the car 3.

Figure 17:
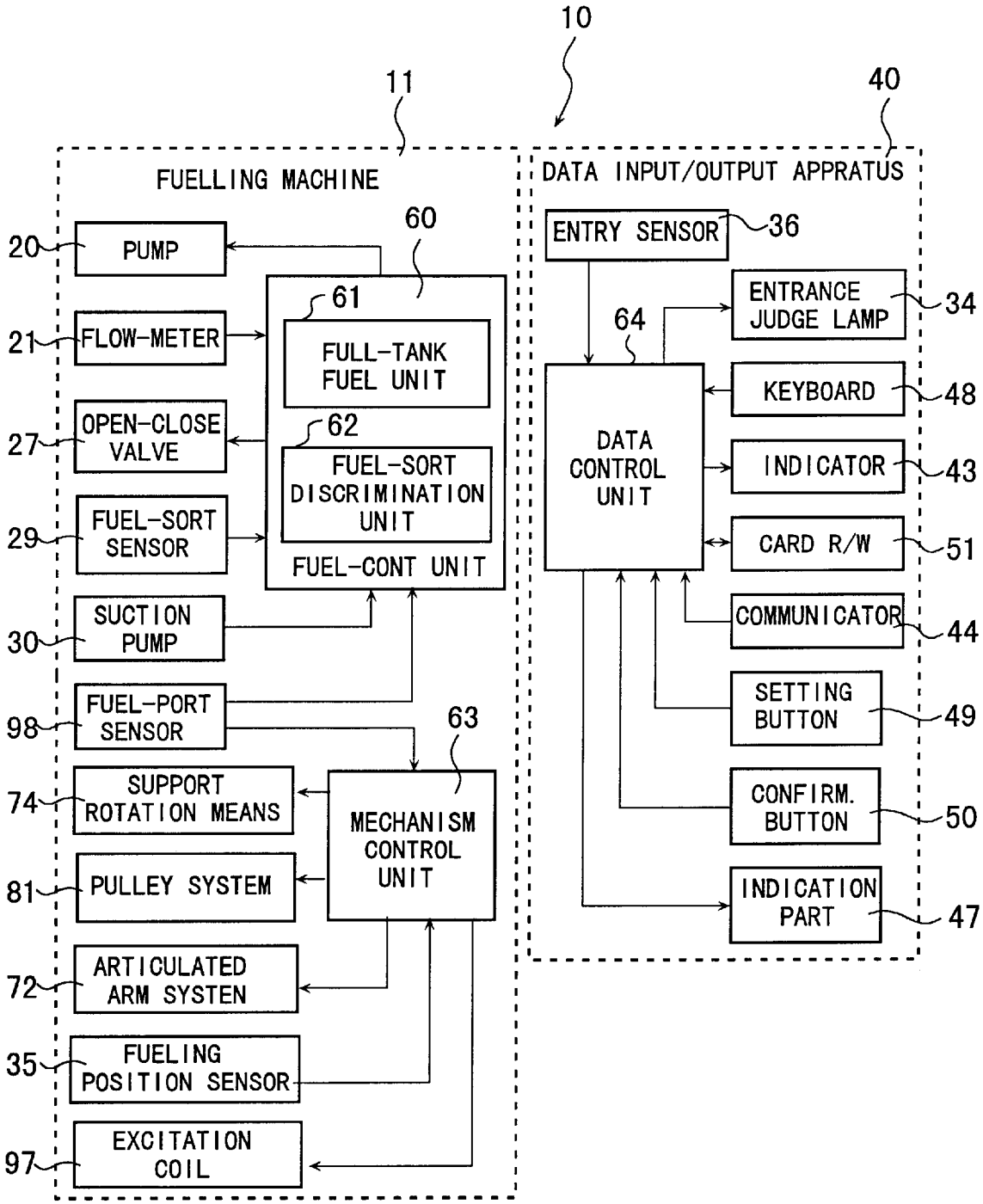
FIG. 17 is a block diagram for explaining the components of an automatic fueling system of the present invention and the functional relationship thereof.

The functional relationship of the constituents of the automatic fueling system 10 in the second embodiment according to the present invention will be explained more precisely with referring to a block diagram shown in FIG. 17.

The fueling machine 11 comprises a fuel-control unit 60 comprising, for instance, a full-tank fueling unit 61 and a fuel-sort discrimination unit 62, the fuel-control unit 60 being connected to a pump 20, a flow-meter 21, an opening-closing valve 27, a fuel-sort sensor 29, a suction pump 30, an fuel-port sensor 98, the fuel-port sensor being connected also to a mechanism control unit 63. The fueling apparatus 11 in the second embodiment is also provided with a mechanism control unit 63 for deciding the position of the nozzle mechanism 73. The mechanism control unit 63 is connected to a fuel-port sensor 98, a support rotation means 74, a pulley system 81, an articulated arm system 72, a fueling position sensor 35 and an excitation coil 97.

Figure 6:
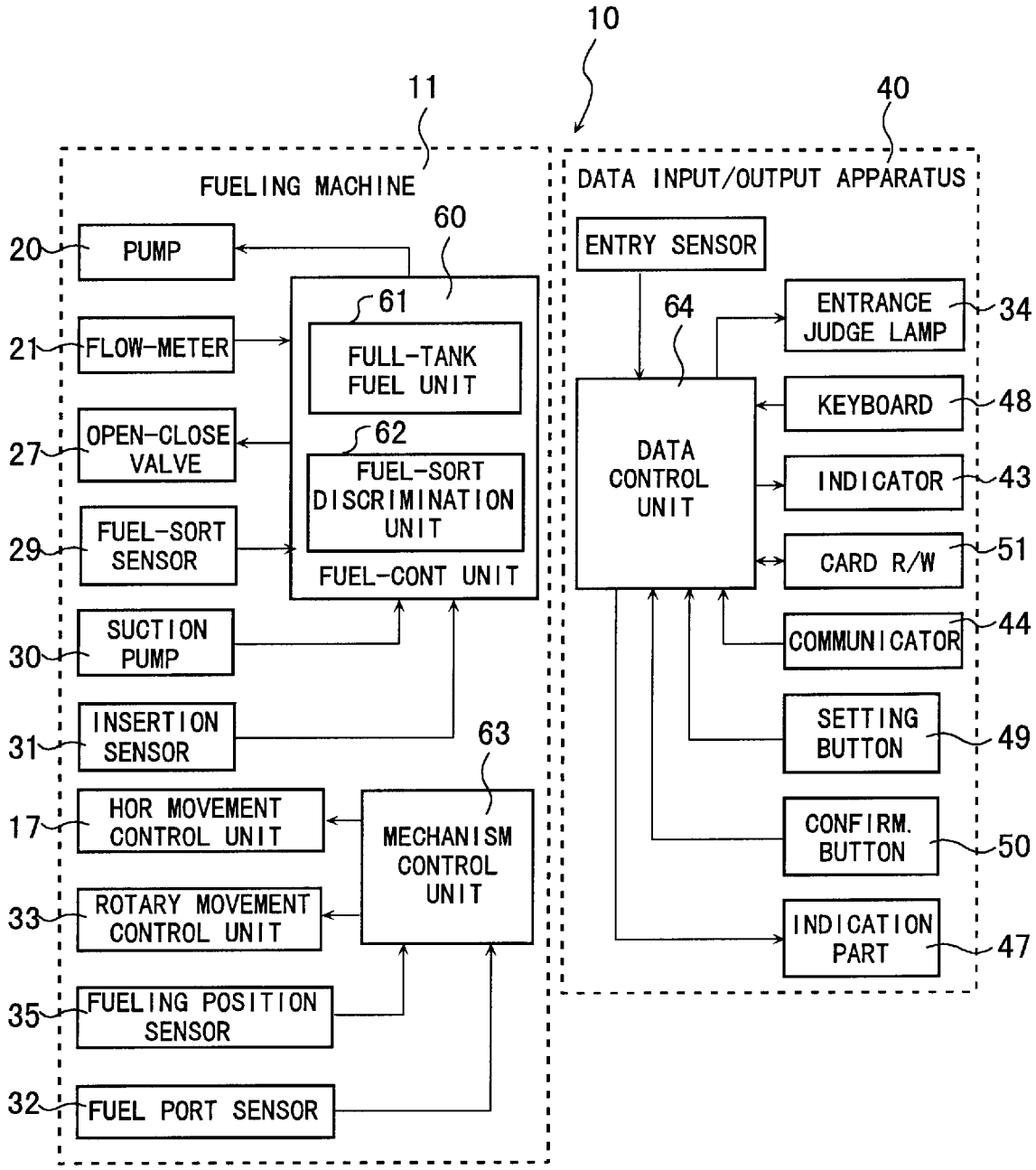
FIG. 6 is a block diagram for explaining the components of an automatic fueling system of the present invention and the functional relationship thereof.

The fueling system 10 also contains a data input/output apparatus 40 contains wherein constituents have connections with each other in the same way as described relating to FIG. 6. Data transmission is performed from the data input/output apparatus 40 to the fueling apparatus 11, and vice versa.

As can be seen from the explanation so far, the nozzle conveyance means in the second embodiment is composed of the support, the hose carrier unit fixed onto the support, the articulated arm system suspended from the hose container, the nozzle mechanism attached at the end of the articulated arm system, the support rotation means for giving a rotational movement to the support, and the mechanism control unit for controlling the support rotation means and the motion of the hose carrier unit.

In the second embodiment, a car 3 to be fueled by the automatic fueling system according to the present invention may have a transmitter 5 such as a transponder nearby a fuel port 4 of the car for transmitting a positional information of the fuel port as shown a partial diagram of FIG. 7.

The fueling machine 10 and the fueling machine 11 in the second embodiment functions as follows:

In the case where there is no car in a fueling area, the entrance judge lamp is being lit, for instance, in blue, which is considered as the indication of the allowance for a car to newly get into the fueling area. At this stage, as fueling machine 11 is in an initial state, namely in a waiting position, as shown in FIG. 12, with the articulated arm system 72 being at the position shown by a two-dot chain line. With the entrance of a car to the fueling area A, ST 1 to ST 6 are carried out as explained above with referring to FIG. 8. Thus, the data control unit 64 transmits the fixed data to the fueling machine 11.

The function of the fueling machine 11 will now be explained by referring to FIG. 18.

The fuel data is transmitted from the data control unit 64 of the data input/output apparatus 40 to the mechanism control unit 63 in the fueling machine 11 (ST31). Thereafter, the positional detection of the fuel port, namely, previously mentioned rough detection is carried out by means of the fuel position sensor 35 provided on horizontally protruded hose container 70 at the bottom surface thereof, and then the fuel-port sensor 98 on the nozzle mechanism 73 detects the precise position of the fueling port (ST32) precise detection), the mechanism control unit 63 causes the support rotation means 74, the pulley system 81, and the articulated arm system 72 to move the tip of the nozzle mechanism 73 to a position facing the fuel port of the car (ST 33).

Where the fueling port of the car is detected, by the fueling position sensor 35, to locate on a side facing the fueling machine 11 (nearby side), the fuel-port sensor 98 receives a positional signal generated from the transmitter 5 in the waiting position as shown in FIG. 12. Based upon the detection signal, the mechanism control unit 63 gives a signal to the support rotation means 74 to rotate the hose container 70 on the support 13 with the articulated arm system 72 being controlled to appropriately bend the bending hose 91 to rotary move the nozzle mechanism 73 to the position facing the nozzle mechanism 73 to the fueling port.

When the fueling port 4 is detected to exist on the opposite side of the car body with respect to the fueling machine 11 by the fueling position sensor 35 (opposite side), the mechanism control unit 63 controls the pulley system 81 to convey the flat-car 77 to the tip of the hose container 70, so that the articulated arm system 72 is carried to the position as illustrated by the solid line in FIG. 12. In this position, the mechanism control unit 63 controls the support rotation means 74 to rotationally move the hose container 70, whereby the nozzle mechanism is carried to a position facing a fueling port. In the case where the car is provided with the previously explained fuel port adaptor 99 and the nozzle mechanism 73 has the nozzle adaptor 92 with the excitation coil 97, the excitation coil 97 is pulled by the magnet 100 of the fuel port adaptor 99 under the magnetization of the coil by the electric supply thereto (ST 34).

When the nozzle insertion to the fueling port is detected by the fuel-port sensor 98 (ST 35), the fuel-control unit 60 causes the suction pump 96 to absorb vapor in a fuel tank of the car, and the fuel-sort discrimination unit 62 causes to work the fuel-sort sensor 95 for sensing the sort of fuel in the vapor form (ST 36). The fuel-sort discrimination unit 62 judges if the fuel sort sensed by the fuel-sort sensor 95 is identical with the fuel-sort which has been instructed by the data input from the keyboard of the data input/output apparatus 40 (ST 37). The fuel-control unit 60 causes the corresponding pump 20 to be driven when the fuel sorts are identical with each other (ST 38).

The fuel stored in an underground fuel-storage tank is transferred through a fueling pipe 19 under the pressure application by means of the pump 20, and discharged into a fueling port by way of the flow-meter 21, the hose 22, the pipe 37, the bellow 93, and, if any, the nozzle adaptor 92 and the fuel port adaptor 99. In the case where the nozzle adaptor 92 and the fuel-port adaptor 99 are employed, the nozzle and the car are combined by the magnetic pulling force as mentioned above, so that the fueling is performed in a very stable manner. The fueling quantity measured by the flow-meter 21 is indicated on the indicator 43 and the indication part 47.

As the fueling is being performed in this way, a full-tank fueling unit 61 functions (ST 40). When the full-tank fueling unit 61 detects that the car is filled with fuel of a preset quantity or filled to a full-tank level (ST 41), the fuel control unit 60 demagnetizes the excitation coil 97, and stops the pump 20 (ST 42), and outputs the data of the fueled quantity to the data input/output apparatus 40 (ST 43). Subsequently, the mechanism control unit 63 controls the support rotation means 74, pulley system 81 and articulated arm system 72 to move the nozzle mechanism 73 (ST 44) to be detached from the fueling port of the car and to brought back to the initial waiting position (ST 45). Thereafter, the communicator 44 indicates the completion of fueling (ST 46).

Figure 8:
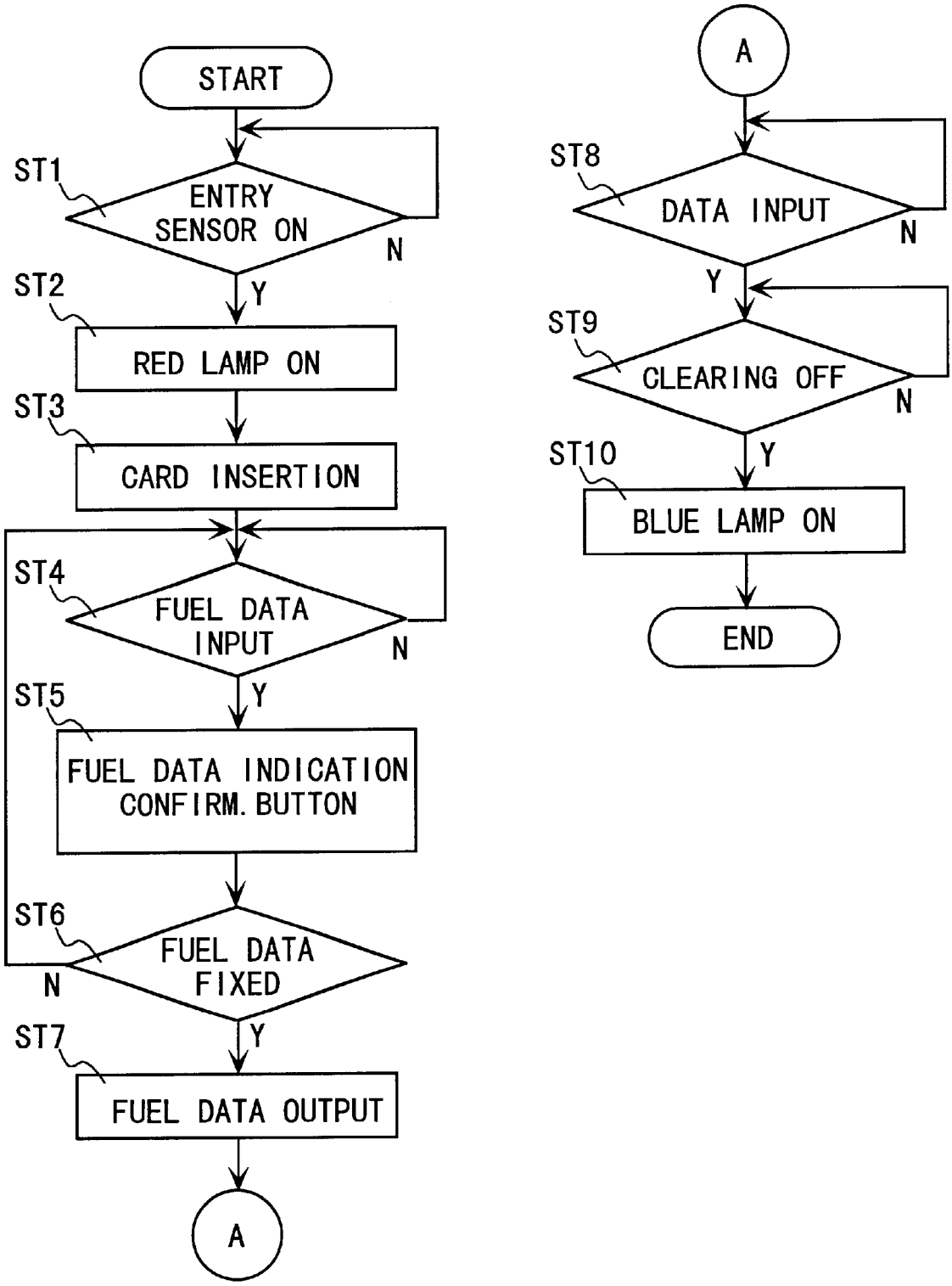
FIG. 8 is a flow-chart for explaining the function of a data input/output apparatus for use in the present invention.

On the other hand, the data input/output apparatus 40, into which fueling data has been input, carries out ST 7 to ST 9 in the same way as explained with using FIG. 8. Thus, all the fueling steps are completed.

Figure 18:
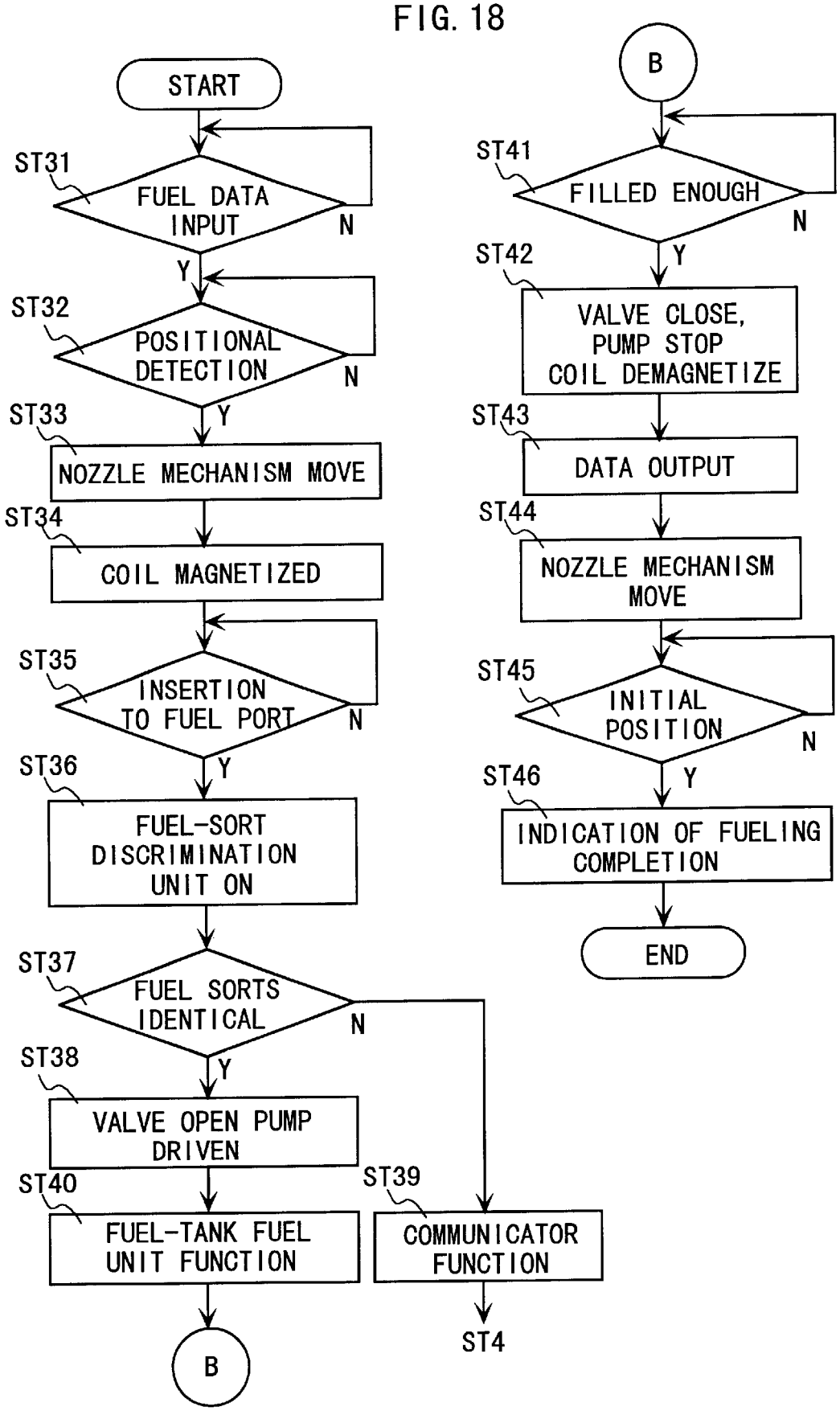
FIG. 18 is a flow-chart for explaining operations of a data input/output apparatus for use in the present invention.

If it is judged at ST 37 in FIG. 18 that the fuel sort already existing in the tank of the customer's car is not identical with the selected fuel sort to be dispensed, the data control unit 64 causes the communicator 44 to function for a certain period of time (ST 39) to indicate the necessity to come back to ST 4 in FIG. 8, that is, to input again a new data. With the input of a correct fuel sort from the keyboard 48, the subsequent fueling steps are carried out as described above.

It is preferable that the articulated arm system of the fueling machine 11 have the waiting state as shown in FIG. 12 by the two-dot line for smoothly starting fueling any time. However, the articulated arm system 72 can be positioned at the position for the opposite-side fueling as illustrated by the solid line.

Figure 19:
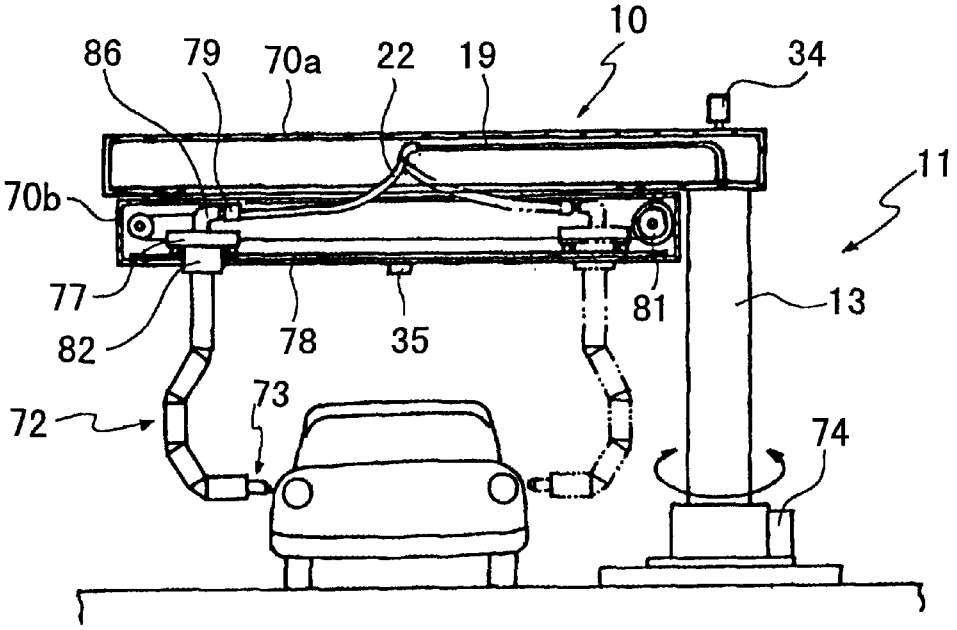
FIG. 19 is a schematic view of a fueling system of the present invention for explaining components and a fueling state thereof.

In the second embodiment, it is possible to omit the hose reel 75 which is shown in FIG. 12 by the provision of two hose containers as shown in FIG. 19, a first hose container 70*a* with one end fixed on the support 13 in the same manner as explained in FIG. 12, and a second container 70*b* which is provided under the first container 70*a* in parallel with each other. The flat-car 77 and a pulley system 81 by which the flat-car 77 is moved along the rail 78 are provided in the second container 70*b*. The fueling pipes lead 19 from an underground tank (not shown) reaches roughly the middle of the hose container 70*a* and is connected to the previously explained arm hose via the hose 22, valve 79.

Figure 20:
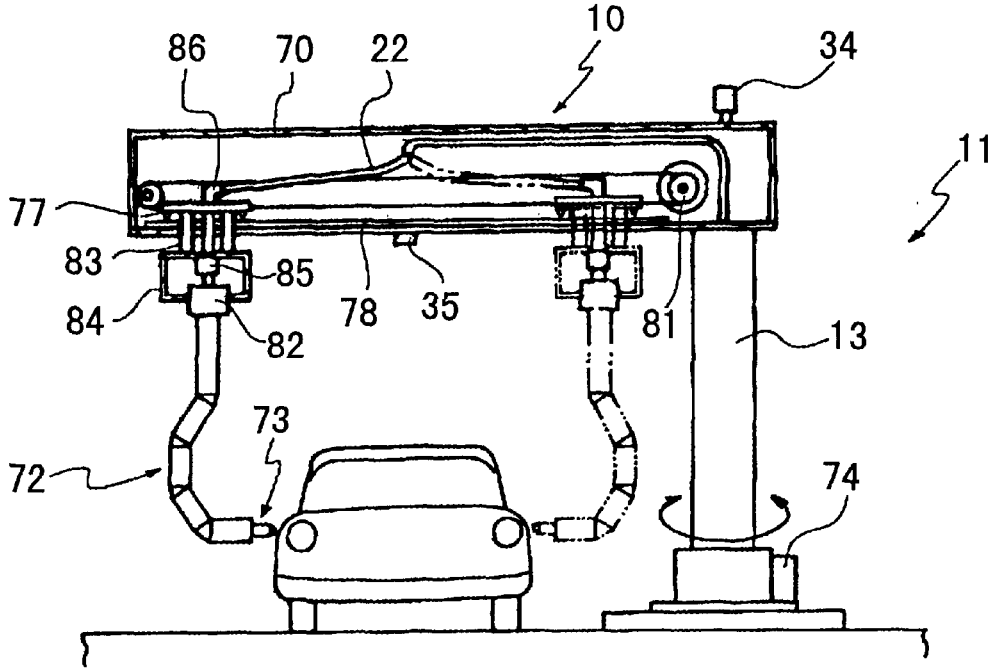
FIG. 20 is a schematic view of a fueling system of the present invention for explaining components and a fueling state thereof.

Alternatively, it is possible to omit the reel as shown in FIG. 20 by providing a moving box 84 below a single hose container 70, being suspended from the flat-car 77 via a support member 83. A connection 82 connects the moving box 84 with the articulated arm member 72. Furthermore, a further valve 85 is provided in the moving box 84.

The other reference numerals than those explained above in FIGS. 19 and 20 respectively indicate the members or parts with the same reference numerals in FIG. 12.

As explained above, the fueling system of the present invention in the second embodiment has the articulated arm system to which compressed air is introduced for appropriately bending the bending hose. Accordingly, the nozzle mechanism is brought into a suitable position facing a fueling port of a car. It is also possible to prepare the articulated arm system as an actuator by that the bending hose is partially covered with a spring system made of a shape-memory metal. To the metal, electricity is supplied to magnetize the same.

It is possible to replace the support rotation means by a horizontal movement control unit used in the first embodiment to move the support horizontally along a rail without rotating the same. The excitation coil explained in the second embodiment can be changed into another means for linking the nozzle to a fuel port adaptor, such as a mechanism by which a pressure contact between the nozzle adaptor and the fuel port adaptor is made by use of a spring or the like.

As can be seen from the above, in the automatic fueling system as the first aspect of the present invention, the opposite-side fueling is automatically performed. Therefore, it is possible to eliminate a fueling operator from the gas station where the automatic fueling system is installed, and a customer can enter the gas station without checking the fueling machine which is for his car.

The previously mentioned fueling position sensor and the fuel-port sensor to be employed in the first and the second embodiments of the present invention and in the variants thereof are selected from apparatus which carries out the positional detection with image processing methods, or can be sensors which functions by use of lights, electromagnetic waves or infrared radiation. In addition, in each of the first and the second embodiments, it is possible to further provide an independent car stopper on the island which protrudes an arm for inhibiting a car to leave the fueling area during the fueling or before the clearing off, under the cooperation with the entry sensor.

The second aspect of the fueling machine according to the present invention will now be explained.

Figure 21:
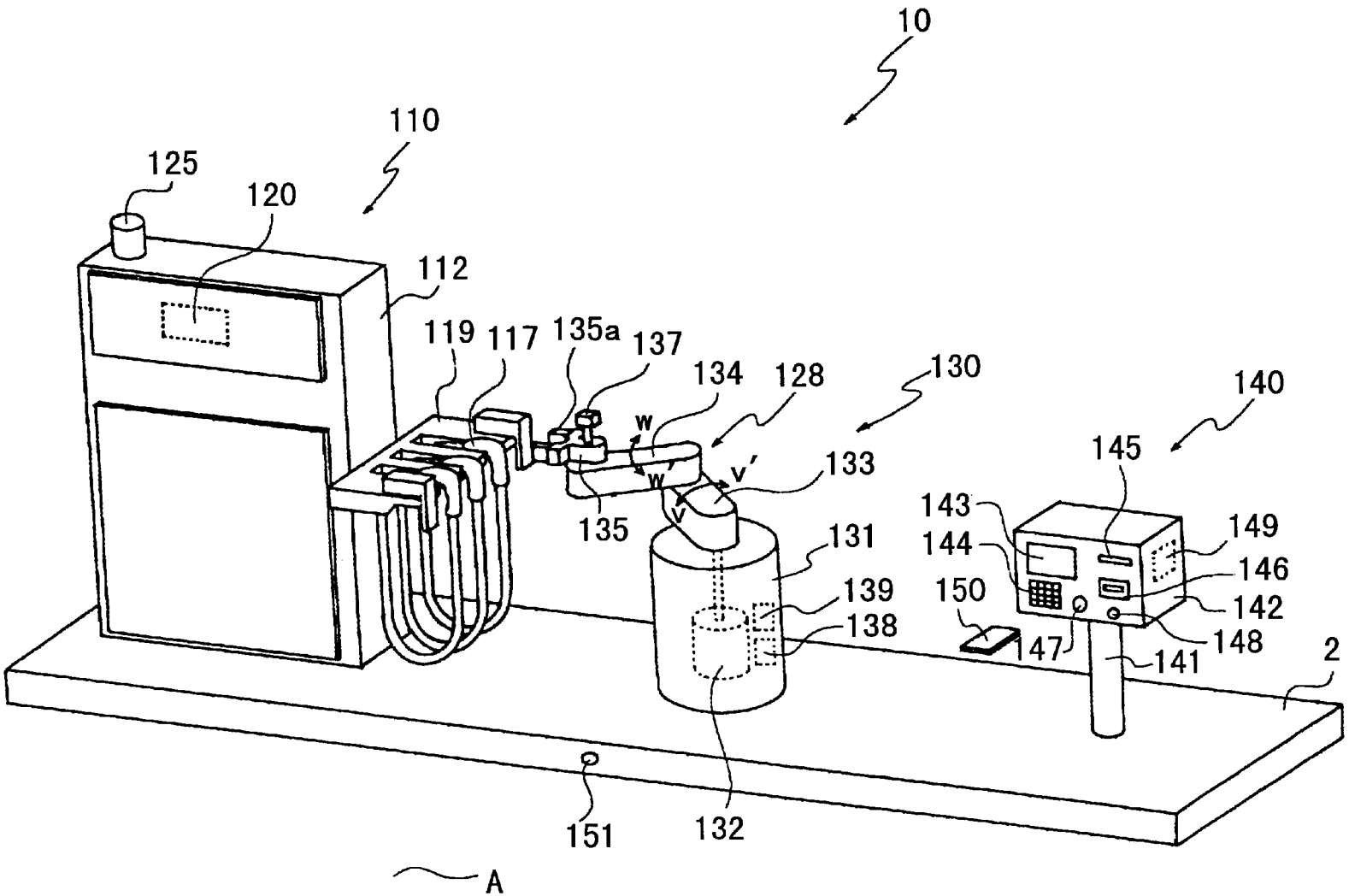
FIG. 21 is a perspective view of a fueling system according to the present invention.

In the perspective view in FIG. 21, a third embodiment of the fueling system 10 of the present invention is illustrated wherein a fueling machine 110, an independent type nozzle conveyance means 130, and a data input/output apparatus 140 are provided on an island 2. The nozzle conveyance means 130 takes one of nozzles 117 of the fueling machine 110 to a fuel port of a car to perform fueling.

Figure 22:
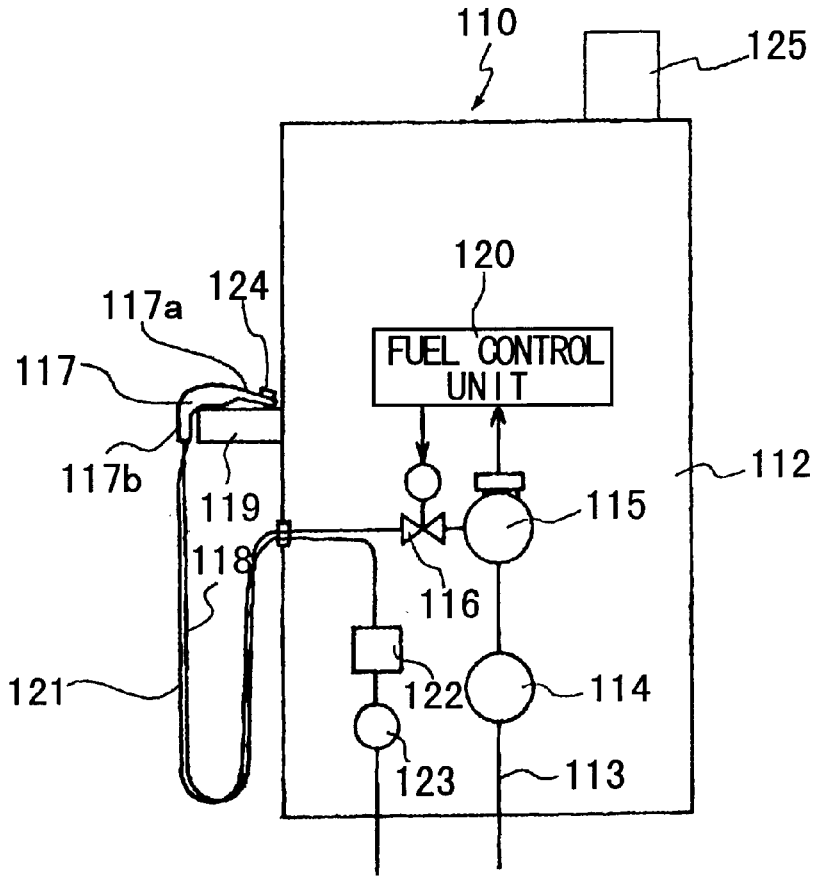
FIG. 22 is a diagram for explaining a structure of a fueling machine for use in the present invention.

The fueling machine 110 comprises a casing 112 wherein, as shown by a schematic diagram of FIG. 22, fueling pipes 113 are respectively connected to fuel-storage tanks provided underground (not shown) of regular, premium and diesel. The fueling pipes 113 are connected to fueling hoses 118 with the provision therebetween pumps 114, flow-meters 115 and opening-closing valves 116. The fueling pipes 113 are led to a side of the casing 112 and are connected with the fueling hoses 118, each with a fueling nozzle 117 at the tip thereof. There is a nozzle stocker 119 at the side of the fueling machine 110 on which the fueling nozzles 117 are hung.

The nozzle stocker 119 is, as also shown in FIG. 21 basically prepared in the form of a horizontal plate with convex and concave parts thereon. The fueling nozzles 117 are placed on the nozzle stocker 119, each with the side of the discharging pipe 117*a* being faced to the fueling machine 110 and the side of a nozzle grip 117*b* being faced to the nozzle conveyance means 130. It is possible to provide the nozzle stocker at any part of the fueling machine as long as the provision of the nozzle stocker helps the smooth function of the nozzle conveyance means 130.

The fueling nozzle 117 is provided with an absorption port (not shown) at the side of discharge pipe 117*a* for detecting which sort of fuel exists in a tank of a car. The gas absorbed from the absorption port is brought back to the underground tank, passing through a hose 121 provided in parallel with each of the fueling hoses 118 and led into the casing 112 together with the fueling hose 118, the hose 121 having a fuel-sort sensor 122 and a suction pump 123 thereon inside the casing. There is provided an insertion sensor 124 on the discharge pipe 117*a* of the fueling nozzle 117 for detecting the insertion of the fueling nozzle 117 to a fueling port of a car, that will be explained later in detail.

Moreover, an entrance judge lamp 125 is provided on the casing 112 which indicates whether or not a car can enter a fueling area A (FIG. 21). The details of the entrance judge lamp 125 are the same as those explained in the first and second embodiments.

As shown in FIGS. 21 and 22, the fueling machine 110 contains therein a fuel-control unit 120 which controls fueling operations.

The nozzle conveyance means 130 in FIG. 21 is provided facing the nozzle stocker 119 on the island 2, with a cylindrical main body 131 containing therein a vertical movement control unit 132 which moves up und down, a first arm member 133 attached on the main body 131, a second arm member 134 on the first arm member 133. In the figure, both the first and second arm members 133 and 134 have a stick like shape, and are employed in a horizontally laid state.

One end of the first arm member 133 is linked with the main body 131, and the second arm member 134 is connected with the other end of the first arm member 133. The first and second members 133 and 134 respectively rotate as shown by arrows in the directions V–V' and W–W'. The nozzle conveyance means 130 further contains a third arm member 135 connected to have a rotational linkage with a free end of the second arm member 134. The third arm member 135 has a gripping part for grasping the nozzle grip 117*a* of the fueling nozzle 117. The first, second and third arm members 133, 134 and 135 constitute a rotary arm system 128.

Figure 23:
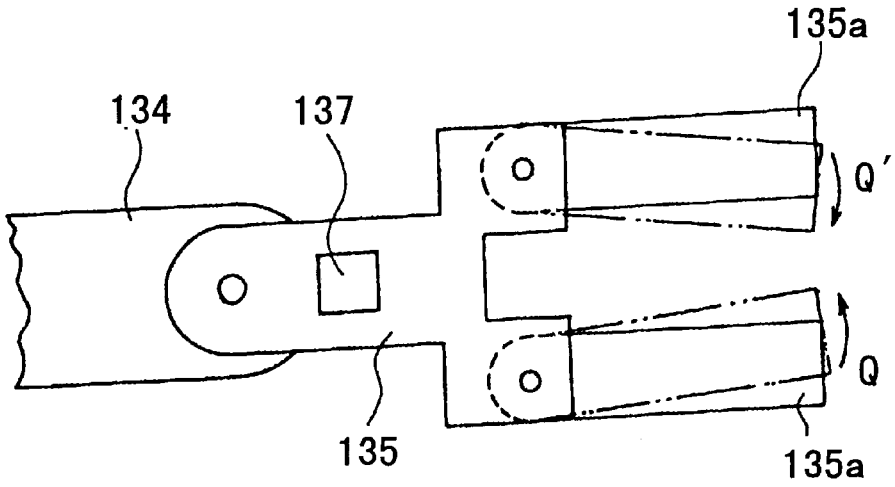
FIG. 23 is a diagram for explaining the motion of a third arm member in a nozzle conveyance means for use in the present invention.

The motion of the third arm member 135 is explained with referring to a partial view thereof in FIG. 23. As explained above the third arm member 135 is attached on the second arm member 134 with the rotational linkage therebetween. The gripping part 135*a* of the third arm member 135 can be prepared as illustrated in FIG. 32 by two stick-like members which move in the directions Q and Q', thereby attaining a fine motion.

In FIG. 21, there is provided a camera 137 such as a CCD camera for detecting the position of a fueling port of a car. An image processing means 138 is provided in the main body 31 for processing the image obtained by the camera 137, and detecting a fuel port of a car. Furthermore, a mechanism control unit 139 for controlling the vertical moving unit 132, and a first, second and third arm members 133, 134 and 135 are contained in the main body 31, of which control is made based on the fueling-port positional information of the fueling port detected by the image processing means 138 and the information written on a card which will be explained later.

The island 2 has an entry sensor 151 at side face thereof to sense the entry of a car to a fueling area A.

The data input/output apparatus 140 is composed of a stand 141 and a housing part 142 thereon wherein an indicator 143, a keyboard 144 for inputting fueling data or the like, a card reading/writing unit 145, a printer 146, a communicator 147, a setting button 148 and a data control unit 149 are provided. The card reading/writing unit 145 reads information recorded on cards employed for clearing off such as a credit card, a banking card, a fueling card, a pre-paid card, and an IC card, and writes new information thereon, and further reads information such as a fueling-port positional data recorded on a fueling data memory card 150 and writes information thereon.

Figure 24:
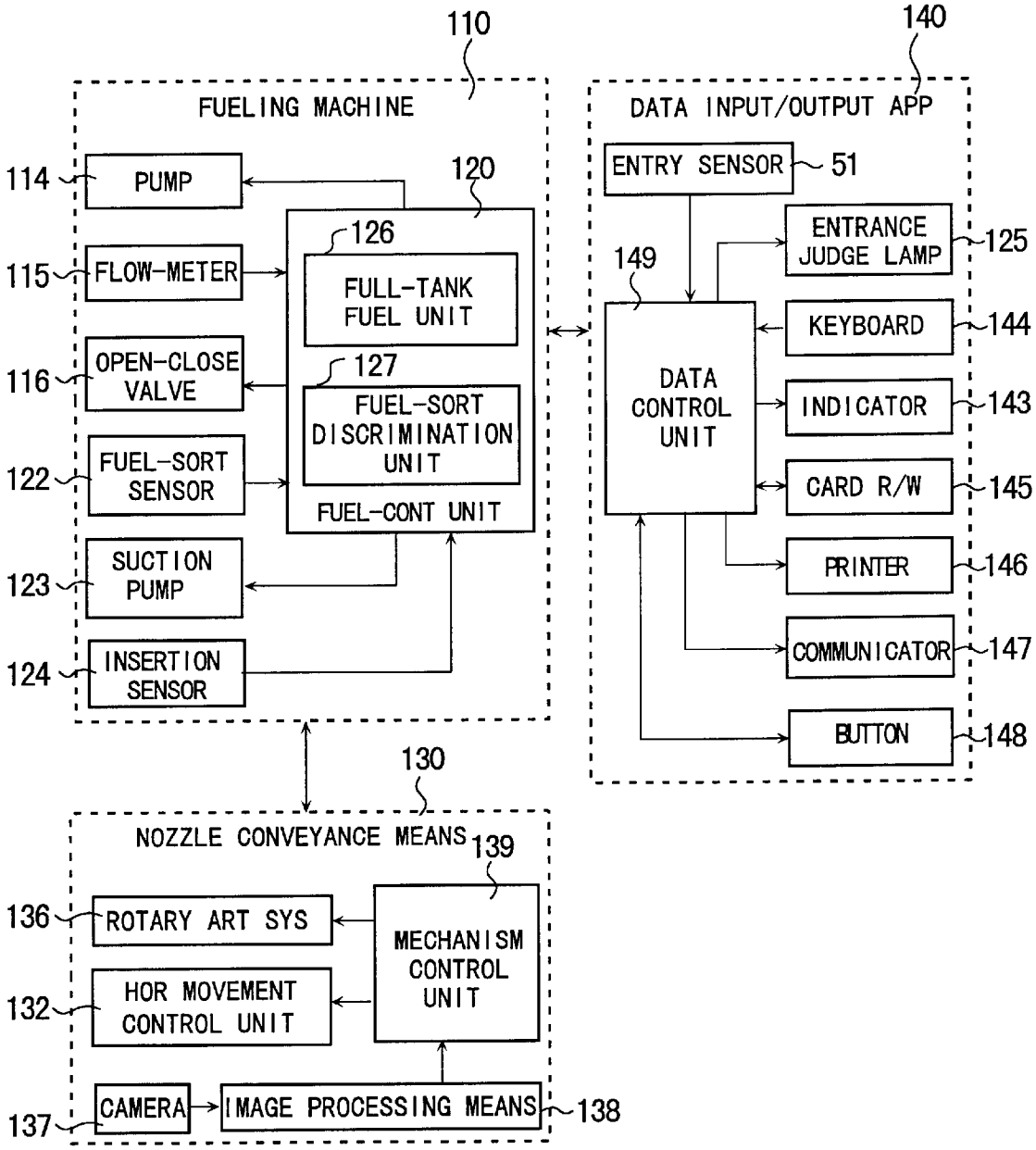
FIG. 24 is a block diagram for explaining the components of an automatic fueling system of the present invention and the functional relationship thereof.

FIG. 24 is a block diagram for explaining the relationship among the constituents in fueling system of the present invention. The fueling machine 110, the nozzle conveyance means 130 and the data input/output apparatus 140 perform necessary data exchange among them.

In this system, the fuel-control unit 120 controls the functions of the pumps 114, suction pumps 123, and the opening-closing valves 116, and calculates the quantity fueled by the receipt of a signal from the flow-meter 115. The fuel-control unit 120 contains the full-tank fueling unit 126 and the fuel-sort discrimination unit 127. Furthermore, the fueling machine 110 comprises the fuel-sort sensor 122 and the insertion sensor 124 as mentioned previously.

Furthermore, the nozzle conveyance means 130 comprises therein the mechanism control unit 139 by which the above-mentioned rotary arm system 128 and the vertical movement control unit 132 are controlled. The camera 137 is connected to the mechanism control unit 139 by way of the image processing means 138.

The data control unit 149 is contained in the data input/output apparatus 140 to which unit 149 a detection signal of a car is transmitted. As explained above, the data control unit 149 is connected with the entrance judge lamp 125 to which the detection signal is output. Furthermore, the data control unit 140 is connected with the keyboard 144, the indicator 143, the card reading/writing unit 145, the printer 146, the communicator 147 and the setting button 148.

Figure 25:
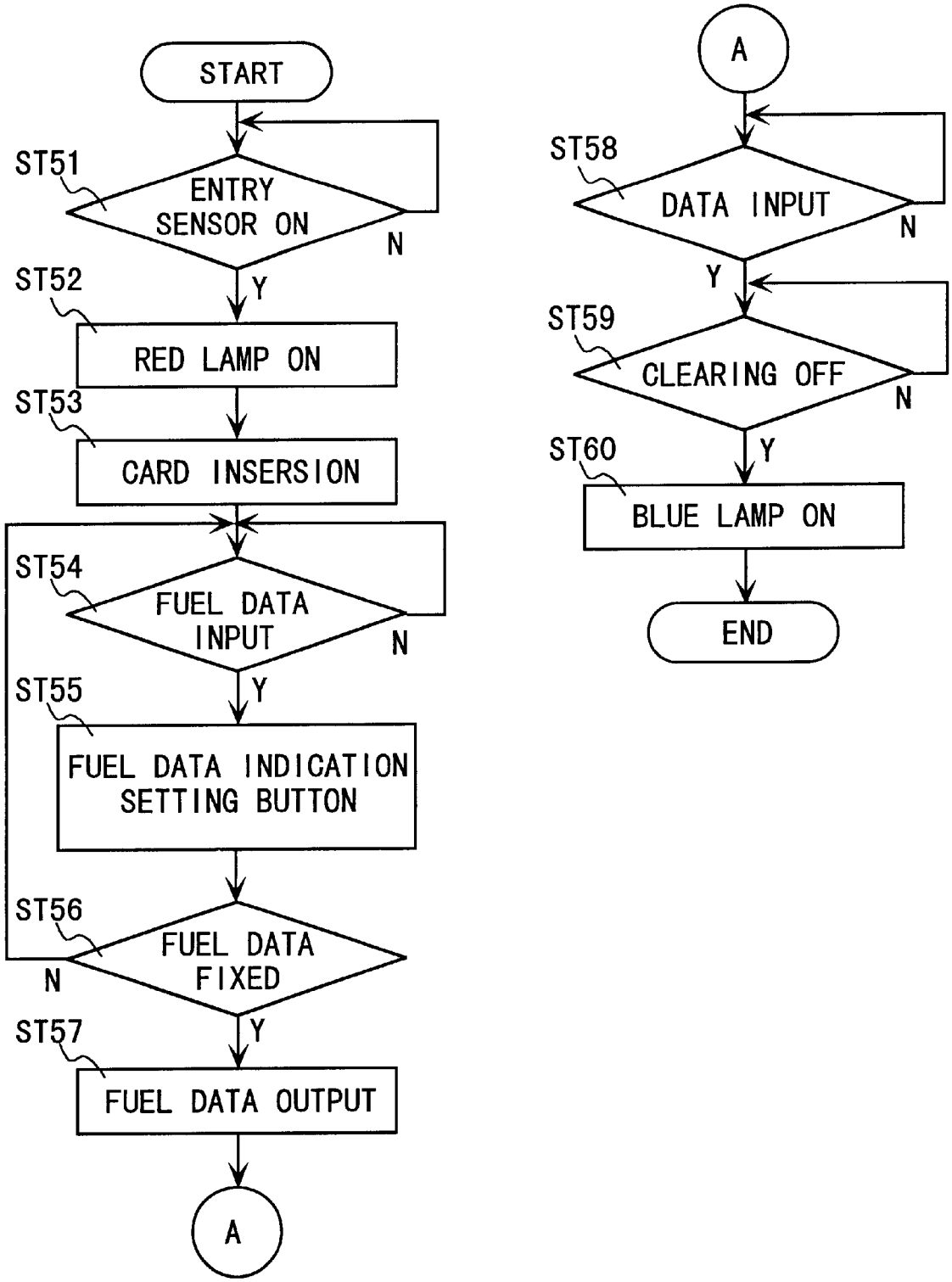
FIG. 25 is a is a flow-chart for explaining the function of a data input/output apparatus for use in the present invention.
Figure 26:
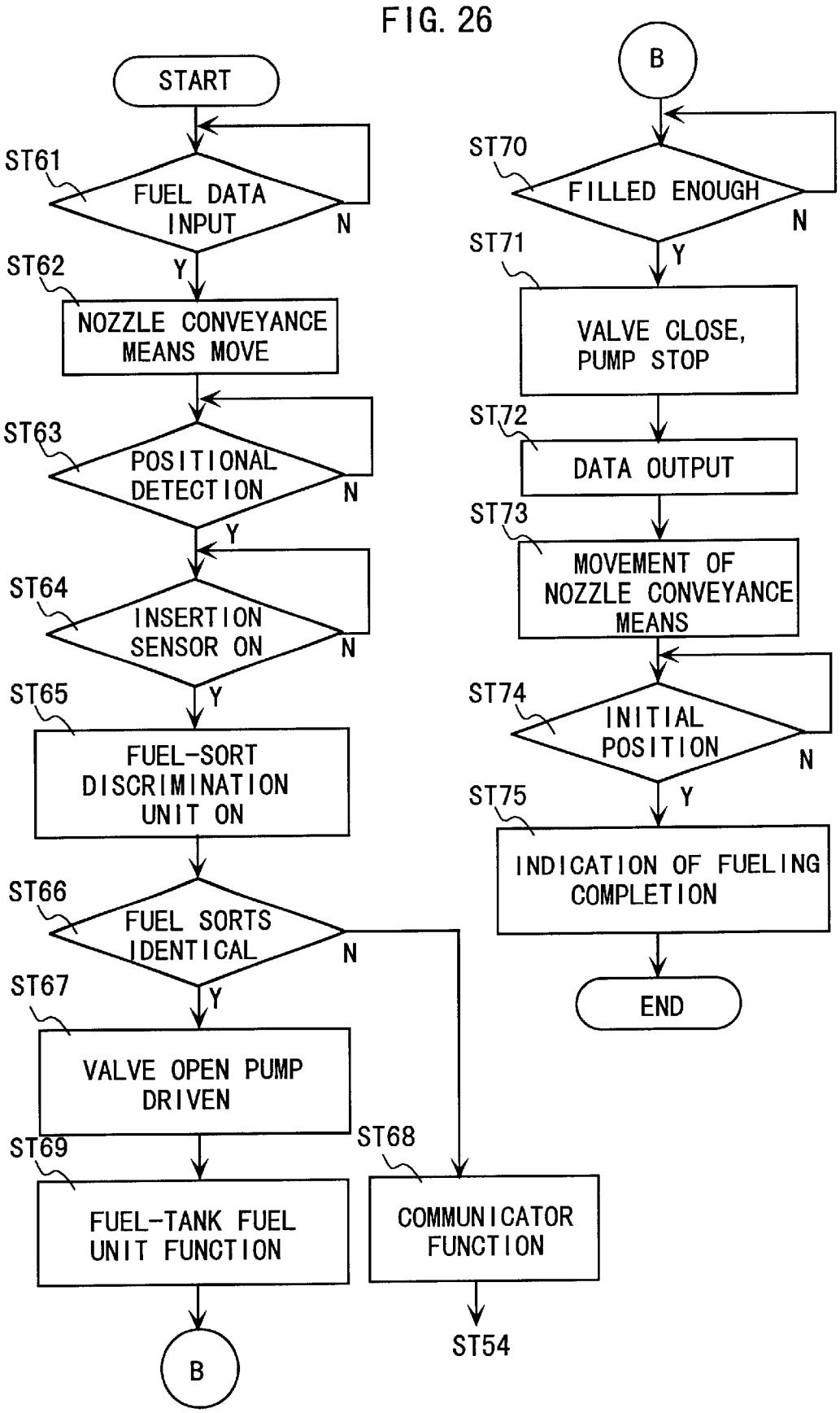
FIG. 26 a flow-chart for explaining the function of a fueling machine for use in the present invention.

The functions of the fueling machine 10 and the data input/output apparatus 11 for use in the present invention are explained respectively based on flow-charts of FIGS. 25 and 26.

In the case where there is no car in a fueling area, the entrance judge lamp 125 is being lit in blue, which is considered also in the third embodiment as the indication of the allowance for a car to newly get into the fueling area A. At this stage, as fueling machine 110 is in an initial state, namely in a waiting position, as shown in FIG. 21, with the fueling nozzle 117 hung on the nozzle stocker 110, and the gripping part 135*a* facing the fueling machine 110.

When a car enters the fueling area A and the entry sensor 136 turns on with the detection of the entrance of the car thereto (ST 51), the data control unit 146 receives a car-detection signal to change the entry judge lamp 125 from blue to red (ST 52) to notify other cars the impossibility to enter the fueling area A.

The input of fueling data to the data input/output apparatus 140 is carried out by a customer with inserting a fueling data memory card 150 to the card reading/writing unit 145 (ST 53). Then, the fueling-port positional data recorded on a fueling data memory card 150 is read and transmitted to the mechanism control unit 139. In addition, further data such as a sort of fuel and quantity to be fueled are input from the keyboards 144 (ST 54), whereby the automatic fueling system of the present invention becomes ready for the following steps of the automatic fueling operation. When fueling data such as a required fuel sort and a quantity thereof is input from the keyboard (ST 54), the input data is indicated on the indicator 143. The setting button 148 is pressed (ST 55) for the fixation of the fueling data (ST 56). Thus, the data control unit 149 transmits the fixed data to the fuel control unit 120 in the fueling machine 110 and the mechanism control unit 139 of the nozzle conveyance means 130.

Thus, the fuel data is transmitted from the data control unit 149 of the data input/output apparatus 140 to the mechanism control unit 139 in the nozzle conveyance means 130 (ST 61 in FIG. 26). In the first place, the rotary arm system 128 moves towards the fueling nozzle 117 of the selected fuel sort which is hung on the nozzle stocker 119, to grasp the gripping part 135*a*, followed by carrying the fueling nozzle 117 towards the fueling port of a car waiting in the fueling area, based upon the fueling-port positional data obtained from the fueling data memory card 150. Then, the image processing means 138 accurately detects the position of the fueling port by the fueling port captured by the camera 137, so that the mechanism control unit 139 and the horizontal movement control unit 133 causes the rotary arm system 128 to insert the tip of the discharge pipe 117*a* into the fueling port of the car (ST 64). At this stage, the fuel-control unit 120 causes the suction pump 123 to absorb vapor in a fuel tank of the car, and the fuel-sort discrimination unit 127 functions (ST 65). The fuel-sort discrimination unit 127 judges whether or not the fuel sort sensed by the fuel-sort sensor 122 is identical with the fuel-sort which has been instructed by the data input from the keyboard of the data input/output apparatus 40 (ST 66). The fuel-control unit 120 opens the opening/closing valve 116 of a required fuel sort and starts to drive the corresponding pump 114 when the fuel sorts are identical with each other (ST 67).

The fuel stored in an underground fuel-storage tank is transferred through the corresponding fueling pipe 113 under the pressure application by means of the pump 114, and discharged into the fueling port by way of the flow-meter 115, the opening/closing valve 116, the fueling hose 118, and the fueling nozzle 117. The fueling quantity measured by the flow-meter 115 is indicated on the indicator 143.

As the fueling is being performed in this way, a full-tank fueling unit 126 functions (ST 69). When the full-tank fueling unit 126 detects that the car is filled with fuel to a full-tank level (ST 70), the fuel control unit 120 closes the opening-closing valve 116, stops the pump 114 (ST 71), and outputs the data of the fueled quantity to the data input/output apparatus 140 (ST 72). Subsequently, the mechanism control unit 139 controls the rotary arm system 128 and the horizontal movement control unit 132 to extract the nozzle pipe 117*a* of the fueling nozzle 117 from the fueling port, with the nozzle conveyance means 111 moved (ST 73) back to the initial waiting position (ST 74). Thereafter, the communicator 47 indicates the completion of fueling (ST 75).

On the other hand, the data input/output apparatus 140, into which fueling data has been input, outputs the data to the fueling machine 11 (ST 57). The data input/output apparatus waits for data to be input from the fueling machine 110 while the fueling is performed by the fueling machine 110. After the data of actually fueled quantity is input from the fueling machine 110 to the data input/output apparatus 140 (ST 58), the apparatus 140 comes to be ready for accepting a customer's card for clearing off fueling charge. With the completion of clearing off (ST 59), the color of the entrance judge lamp is changed from red to blue. Thus, all the fueling steps are completed.

If it is judged at ST 66 in FIG. 26 that the fuel sort already existing in the tank of the customer's car is not identical with the selected fuel sort to be dispensed, the data control unit 149 causes the communicator 147 to function for a certain period of time (ST 68) to indicate the necessity to come back to ST 54 in FIG. 25, that is to input again a new data. With the input of a correct fuel sort from the keyboard 144, the subsequent fueling steps are carried out as described above.

In the automatic fueling system as the second aspect of the present invention, the nozzle conveyance means is independent from the fueling machine, so that it is possible to produce the fueling system in a minimum cost with eliminate the labor to incorporate a complicated pipe arrangement in the fueling machine, and the utilization of the conventional fueling machine and data input/output apparatus as they are. It is matter of course the fueling system of the present invention does not require a manual fueling operation except the insertion of a card to the data input/output apparatus.

In the above embodiment, the accurate positional detection is carried out by the camera provided on the rotary arm system. It is possible, however, to accurately detect the position of a fueling port by the provision of a transmitter such as a transponder as precisely described in the above first and the second embodiments.

In addition to the above, it is also possible to prepare the rotary arm member with the number of the arm members and the shapes thereof being differed from the above embodiments as long as the nozzle conveyance means appropriately carries a nozzle. For instance, the nozzle conveyance means can be prepared from arm members which rotary move in a vertical direction.

As is obvious from the above explanation, the fueling operation by use of all the types of the above-mentioned fueling system can be automatically performed a fueling operator in the gas station conveniently and safely. Therefore, it is not necessary to position in a gas station, a fueling operator who is well trained in the fueling operation. In the automatic fueling system of the present invention, it is only necessary for customers to insert cards to the system, and the customers also do not need to perform a substantial fueling operation with which some danger and/or annoyance such as scattering of fuel or unpleasant odor accompany.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An automatic fueling system to be provided in a gas station for dispensing fuel to a vehicle, comprising:

a fueling machine comprising a fueling pipe connected to a fuel-storage tank provided in the gas station, and a fueling nozzle connected to said fueling pipe via a hose, a nozzle conveyance means comprising an arm mechanism, a mechanism control unit for controlling the movement of said arm mechanism, and a fuel-port sensor for sensing the position of a fueling port of the vehicle, said nozzle conveyance means automatically conveying said fueling nozzle to the fueling port and automatically inserting said fueling nozzle thereto under the control of said mechanism control unit, the fueling port being located in at least one of two locations, a first location on a first side of the vehicle and a second location on a different side of the vehicle, and a data input/output apparatus for inputting fueling information therefrom and outputting the fueling information to said fueling machine and said nozzle conveyance means, said fueling nozzle being conveyed by said nozzle conveyance means to the fueling port in one of said first and second locations by the receipt of the fueling information from said data input/output apparatus, said fueling machine starting and stopping fueling based on the fueling information, said fueling nozzle being extracted from the fueling port with the receipt of a signal from said mechanism control unit.

2. The automatic fueling system as claimed in claim 1, wherein said nozzle conveyance means is at least partially contained in said fueling machine.

3. The automatic fueling system as claimed in claim 1, wherein said fuel-port sensor senses the position of the fueling port by detecting a signal generated from a transmitter provided on the vehicle nearby the fueling port.

4. The automatic fueling system as claimed in claim 3, wherein said nozzle conveyance means is at least partially contained in said fueling machine.

5. The automatic fueling system as claimed in claim 4, further comprising a fueling position sensor for sensing on which side of the vehicle the fueling port exists, and said fueling port sensor conducting the detection before the detection by said fuel-port sensor.

6. The automatic fueling system as claimed in claim 4, wherein said arm mechanism comprises a first arm member, a second arm member of which one end is rotationally connected to said first arm member on the other end thereof and a nozzle mechanism connected to said second arm member on the other end thereof said fueling nozzle projects from said nozzle mechanism.

7. The automatic fueling system as claimed in claim 6, wherein said nozzle conveyance means further comprises a horizontal movement control unit for horizontally moving said nozzle conveyance means and a rotary movement control unit for rotary moving said arm mechanism, said horizontal control unit and said rotary movement control unit being controlled by said mechanism control unit.

8. The automatic fueling system as claimed in claim 4, wherein said arm mechanism comprises a support, a hose carrier unit, an articulated arm system, and a nozzle mechanism, said hose carrier unit is contained in a hose container, said hose container is in a long box-like shape being provided on said support with one end of said casing being fixed to said support, the other end thereof being connected with said articulated arm, said hose container is horizontally protruded over a fueling area in the gas station, said articulated arm system is suspended from said hose container and is movable in the longitudinal direction of said hose container, and said articulated arm system comprises therein an arm hose to which said fueling hose is connected.

9. The automatic fueling system as claimed in claim 8, wherein said nozzle mechanism comprises a nozzle adaptor by which said nozzle is fit with a fueling port of a vehicle to be fueled.

10. The automatic fueling system as claimed in claim 8, said hose container is fixed on said support, and said nozzle conveyance means further comprises a support rotation means, said support rotation means causes said support to rotate under the control of said mechanism control unit.

11. The automatic fueling system as claimed in claims 10, wherein said nozzle adaptor comprises an excitation coil thereon to which electricity is supplied under the control of said mechanism control unit.

12. The automatic fueling system as claimed in claim 8, wherein said nozzle conveyance means further comprises a horizontal movement control unit for horizontally moving said nozzle conveyance means under the control of said mechanism control unit.

13. The automatic fueling system as claimed in claim 8, wherein said hose carrier unit further comprises a hose reel in said hose container, said hose is wound onto said hose reel and drawn out therefrom.

14. The automatic fueling system as claimed in claim 1, wherein said arm mechanism comprises a first arm member, a second arm member of which one end is rotationally connected to said first arm member on the other end thereof and a nozzle mechanism connected to said second arm member on the other end thereof, said fueling nozzle projects from said nozzle mechanism.

15. The automatic fueling system as claimed in claim 1, wherein said arm mechanism comprises a support, a hose carrier unit, an articulated arm system, and a nozzle mechanism, said hose carrier unit is contained in a hose container, said hose container is in a long box-like shape being provided on said support with one end of said casing being fixed to said support, the other end thereof being connected with said articulated arm, said hose container is horizontally protruded over a fueling area in the gas station, said articulated arm system is suspended from said hose container and is movable in the longitudinal direction of said hose container, and said articulated arm system comprises therein an arm hose to which said fueling hose is connected.

16. An automatic fueling system to be provided in a gas station for dispensing fuel to a vehicle, comprising:

a fueling machine comprising at least one fueling pipe connected to a fuel-storage tank provided in the gas station, and a fueling nozzle connected to said fueling pipe via a hose, a nozzle conveyance means comprising an arm system, a mechanism control unit, for automatically conveying said fueling nozzle to a fueling port of the vehicle parked on either side of said fueling machine by grasping said fueling nozzle, and automatically inserting said fueling nozzle by the movement of said arm system under the control of said mechanism control unit, and a data input/output apparatus for inputting fueling information therefrom and outputting the fueling information to said fueling machine and said nozzle conveyance means, said fueling machine starting and stopping fueling based on the fueling information, said fueling nozzle being extracted from the fueling port with the receipt of a signal from said mechanism control unit, said nozzle conveyance means being independent of said fueling machine.

17. The automatic fueling system as claimed in claim 16, wherein said fueling machine comprises a casing and a nozzle stocker provided on the casing, said fueling nozzle is hung on said nozzle stocker and taken off therefrom by said nozzle conveyance means.

18. The automatic fueling system as claimed in claim 16, wherein said nozzle conveyance means further comprises a camera and an image processing means for detecting the position of the fueling port, said image processing means outputting an image detection signal, said nozzle conveyance means grasps, carries and inserts said nozzle to the fueling port, and brings said fueling nozzle to an initial position.

19. The automatic fueling system as claimed in claim 16, wherein said nozzle conveyance means further comprises a sensor for detecting the position of a fueling port of a vehicle, and is employed for a vehicle with a transmitter nearby a fueling port thereof.

20. The automatic fueling system as claimed in claim 16, wherein said data input/output apparatus comprises a card reading/writing unit which reads a fueling port positional data recorded on a card, and outputs the data to said mechanism control unit.

* * * * *